US010221633B2

(12) United States Patent
Wollmann et al.

(10) Patent No.: US 10,221,633 B2
(45) Date of Patent: Mar. 5, 2019

(54) SUCKER ROD SHEAR COUPLERS

(71) Applicant: Innovative Tool Technology Inc., Lloydminster (CA)

(72) Inventors: Arnold Wollmann, Lloydminster (CA); Aaron Brassard, Calgary (CA); Wray Sparling, Calgary (CA); John Doyle, Calgary (CA)

(73) Assignee: Innovative Tool Technology Inc., Lloydminster (CA)

( * ) Notice: Subject to any disclaimer, the term of this patent is extended or adjusted under 35 U.S.C. 154(b) by 0 days.

(21) Appl. No.: 15/128,520

(22) PCT Filed: Mar. 31, 2015

(86) PCT No.: PCT/CA2015/050257

§ 371 (c)(1),
(2) Date: Sep. 23, 2016

(87) PCT Pub. No.: WO2015/149174

PCT Pub. Date: Oct. 8, 2015

(65) Prior Publication Data

US 2017/0356252 A1 Dec. 14, 2017

Related U.S. Application Data

(60) Provisional application No. 61/974,186, filed on Apr. 2, 2014, provisional application No. 61/977,704, filed
(Continued)

(51) Int. Cl.

| | |
|---|---|
| ***E21B 17/06*** | (2006.01) |
| ***E21B 17/10*** | (2006.01) |
| *E21B 17/042* | (2006.01) |

(52) U.S. Cl.
CPC ..... *E21B 17/06* (2013.01); *E21B 17/1071* (2013.01); *E21B 17/042* (2013.01)

(58) Field of Classification Search
CPC ..... E21B 17/06; E21B 17/1071; E21B 17/042
(Continued)

(56) References Cited

U.S. PATENT DOCUMENTS 4,411,546 A * 10/1983 Fischer ..... E21B 17/00 403/2
4,459,060 A 7/1984 Patterson
(Continued)

FOREIGN PATENT DOCUMENTS

CA 2432501 6/2011

*Primary Examiner* — Taras P Bemko
(74) *Attorney, Agent, or Firm* — Kyle R Satterthwaite; Ryan W Dupuis; Ade & Company Inc.

(57) ABSTRACT

A shear coupler provides a breakable connection between adjacent members of a pump rod string. The coupler features an elongated shear stud, a hollow member in which the shear stud is axially received, a first set of rotational locking features externally defined on the shear member for engagement with a first set of matable rotational locking features internally defined on the hollow member; and a second set of rotational locking features externally defined on the shear member for engagement thereof with a second set of matable rotational locking features internally defined on the hollow member. The first and second sets of rotational locking features of the shear member are disposed on opposite sides of a weakened area thereof, and tensile and torsional loads on the coupler are substantially isolated from one another. Methods and equipment for applying torsional and tensile pre-loads to the coupler are also provided.

20 Claims, 14 Drawing Sheets

Related U.S. Application Data on Apr. 10, 2014, provisional application No. 62/099,816, filed on Jan. 5, 2015.

(58) Field of Classification Search
USPC ..... 166/241.6
See application file for complete search history.

(56) References Cited

U.S. PATENT DOCUMENTS 5,470,118 A * 11/1995 Burton ..... E21B 17/06
294/86.18
8,636,057 B2 1/2014 Wolodko

* cited by examiner

SUCKER ROD SHEAR COUPLERS

This application is the national stage of PCT/CA2015/050257, filed Mar. 31, 2015, and claims benefit under 35 U.S.C. 119(e) of U.S. Provisional Application Ser. No. 61/974,186, filed Apr. 2, 2014; U.S. Provisional Application Ser. No. 61/977,704, filed Apr. 10, 2014, and U.S. Provisional Application Ser. No. 62/099,816, filed Jan. 5, 2015.

FIELD OF THE INVENTION

The present invention relates generally to shearable connections between adjacent sections of a pump rod string, and more specifically to a shear coupler employing an elongated shear member and one or more hollow members closing around the shear member to augment the torque transfer capabilities thereof.

BACKGROUND

It is well known in the art to use shear couplers between adjacent sucker rods in a sucker rod string that is used to drive a downhole pump in a wellbore for the purpose of producing hydrocarbon fluids to the surface. Conventionally, such couplers feature inner and outer members that mate together in an axial manner placing a portion of the inner member within a hollow interior of the other member, and then one of more shear pins that lock together these members by passing radially through the wall of the outer member into engagement with the inner member.

Other shear couplers have employed a reduced-diameter shear neck between the body and externally threaded head of a pin coupler that is matingly threaded into an internally threaded box coupler, as shown in Canadian Patent No. 1298715, in which the solution is described as being advantageous over shear pin designs in which the pins have been known to prone to premature fatigue.

U.S. Patent Application Publication No. 2009/0271966 discloses another pin coupler with a shear neck that adds an additional means for preventing backing off of the threaded connection between the pin and box couplers by radially expanding the head of the pin coupler by forcing a ball bearing into a counterbore in the head, where slots radiating outwardly from the counterbore allow the head to deform outwardly into tighter engagement with the threads of the surrounding box coupler.

U.S. Patent Application Publication No. 2004/0202521 discloses a box coupler with a similar stress concentration point of reduced diameter at which the string will shear under sufficient axial force, but using external circumferential groove the coupler body to form this weakened intentional-failure point.

U.S. Pat. No. 4,411,546 discloses a sucker rod shear coupler in which a shear neck of the coupler body is surrounded by an outer sleeve that is sealed to the body above and below the shear neck to protect the shear neck from corrosive fluids and prevent deflection of same. The shear coupler is used in a reciprocating, rather than rotating, sucker rod string driven by a walking beam to operate a reciprocating downhole pump. The coupler lacks any means for rotationally locking the sleeve to other components, whereby if used in a rotational sucker rod string to drive a rotary downhole pump, the sleeve would be limited in its ability to effectively transfer torque across the coupler during rotation of the sucker rod string, thereby relying heavily or entirely on the shear neck to provide the torque handling capacity of the coupler.

U.S. Pat. No. 5,470,118 discloses a shear device for use with a well service tool on a sandline. Using end caps threaded onto opposing ends of the shear body, an outer sleeve is once again disposed around the shear body to protect the shear neck and prevent deflection of same. The lower cap and the sleeve are not interlocked, but rather remain in axially-slidable relation to one another, whereby the sleeve would not transfer torque across the coupler in the event that it were applied to a rotationally driven sucker rod string.

U.S. Pat. No. 8,636,057 discloses a shear coupling again having a necked shear body and surrounding outer sleeve, but additionally adds an internally threaded locking member that threads onto an externally threaded male end of the shear body inside the bore of the hollow sleeve in order to maintain the shear body in a state of axial pre-tension to enhance fatigue resistance in reciprocating pump applications or rotary pump applications with wellbore deviations. An end of the outer sleeve and a shouldered area of the shear body against which the end of the sleeve is abutted are matingly profiled with a polygonal cross-section to enable co-rotation of the two components and torque transfer across same for use in rotary pump applications.

U.S. Patent Application Publication 2013/0032326 also discloses a shear coupling featuring a reduced-neck inner shear body and surrounding outer sleeve, which have mating polygonal profiles to enable torque transfer across the coupling.

Applicant has developed unique shear coupler designs that are useful as alternatives and/or improvements to the forgoing prior art.

SUMMARY OF THE INVENTION

According to a first aspect of the invention, there is provided a shear coupler for providing a breakable connection between adjacent members of a sucker rod string for use in a wellbore, the shear coupler comprising:

a shear member comprising an elongated stud having opposing first and second ends spaced apart along a longitudinal axis, first and second sets of threads defined on the shear member at locations respectively adjacent the opposing first and second ends thereof, and a weakened area on the elongated stud at an intermediate location between the first and second sets of threads;

a hollow member having a hollow interior that extends thereinto from an open end of said hollow member along a longitudinal axis thereof, the first end of the shear member being passable through the open end of said hollow member to place the outer member in an installed position closing around the shear member; and a first set of rotational locking features externally defined on the shear member for engagement thereof in the installed position with a first set of matable rotational locking features internally defined on the hollow member;

a second set of rotational locking features externally defined on the shear member for engagement thereof in the installed position with a second set of matable rotational locking features internally defined on the hollow member;

the first and second sets of rotational locking features of the shear member being disposed on opposite sides of the weakened area thereof, and being arranged to mate with the matable rotational locking features of the hollow member in the installed position in a manner locking the hollow member from rotation relative to the shear member to enable torque transfer across the weakened area of the shear member via the hollow member disposed around said shear member.

According to a second aspect of the invention, there is provided a method of assembling a shear coupler useful for providing a breakable connection between adjacent members of a sucker rod string for running into a wellbore, the method comprising:

(a) having a shear member;

(b) having a hollow member;

(c) applying a torque to the shear member in a manner twisting said shear member about a longitudinal axis thereof;

(d) with the torque maintained on the shear member, mating the hollow and shear members together into an assembled condition in which the hollow and shear members are in an interlocked relation with one another that prevents relative rotation therebetween about the longitudinal axis; and (e) removing the torque from the shear member, whereupon a torsional pre-load is maintained in the shear member by the interlocked relation between the hollow and shear members.

According to a third aspect of the invention, there is provided a method of assembling a shear coupler useful for providing a breakable connection between adjacent members of a sucker rod string for running into a wellbore, the method comprising:

(a) having a shear member;

(b) having a hollow member;

(c) mating the hollow and shear members together in a position abutting a first end of the hollow member against an external shoulder on the shear member with a set of external threads on the shear member exposed outside the hollow member beyond a second end thereof;

(c) applying a tensile force to the shear member in an axial direction in which the external threads on the shear member are spaced from the external shoulder on the shear member;

(d) with the tensile force maintained on the shear member, advancing an internally threaded stop member on the external threading of the shear member into a position abutting the stop member against the second end of the hollow member; and (e) removing the tensile force from the shear member, whereupon a tensile pre-load is maintained the shear member.

BRIEF DESCRIPTION OF THE DRAWINGS

Preferred embodiments of the invention will now be described in conjunction with the accompanying drawings in which.

In the drawings like characters of reference indicate corresponding parts in the different figures.

DETAILED DESCRIPTION

Figure 1:
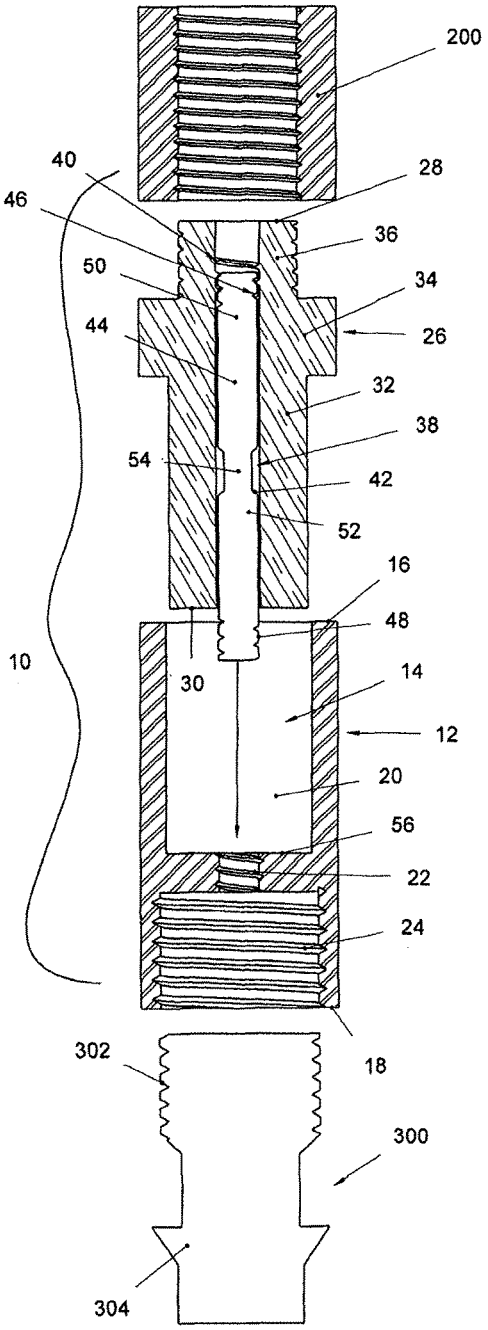
FIG. 1 is a partially exploded view of a shear coupler according to a first embodiment of the present invention for installation between a sucker rod and a box coupler in a sucker rod string used to drive a downhole pump.

FIG. 1 shows a first embodiment shear coupler 10 of the present invention that forms a shearable connection between a sucker rod 300 located below the shear coupler 10 and a box coupler 200 located above the shear coupler within an assembled sucker rod string that is used to drive a downhole pump in a wellbore in order to produce hydrocarbon fluids to surface through a string of production tubing that surrounds the sucker rod string.

The shear coupler 10 features an outer member 12 of externally cylindrical shape having a hollow interior 14 that passes fully through the member from the top end 16 thereof to an opposing bottom end 18 on a central longitudinal axis of the member's cylindrical shape. The hollow interior is made up of three distinct sections, particularly a smooth-walled cylindrical upper section 20 extending from the top end 16, an internally threaded intermediate section 22 of smaller diameter than the top section 20 and residing immediately therebeneath, and an internally threaded lower section 24 of larger diameter than the intermediate section and residing therebeneath in a position reaching to the bottom end 18 of the member 10. The lower section 24 is threaded in a manner matable with the external threading of the pin end 302 of the conventional sucker rod 300, thus defining a female box end at the bottom of the shear coupler. The annular face of the bottom end 18 of the outer member 10 abuts against the flat upper side of the shoulder 304 of the sucker rod 300 from which the pin end 302 axially projects when the box end of the outer member is coupled to the pin end of the sucker rod.

Figure 2:
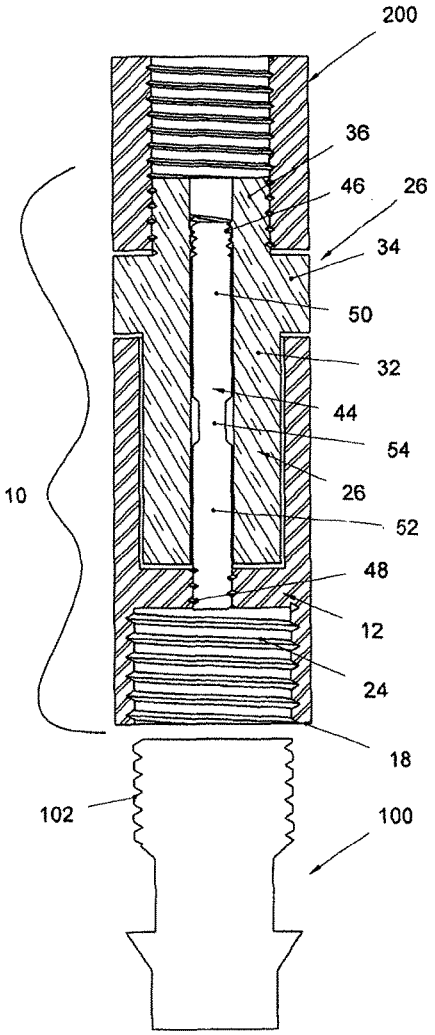
FIG. 2 is an assembled view of the shear coupler of FIG. 1.

The shear coupler 10 also features an inner member 26 having top and bottom ends 28, 30 spaced apart along a central longitudinal axis of the inner member 26 that aligns with the central longitudinal axis of the outer member when the shear coupler is assembled for use in the sucker rod string. A lower portion 32 of the inner member extends upward from the bottom end 30 thereof and is externally cylindrical in shape. An intermediate shoulder portion 34 disposed immediately above the lower portion 32 is also externally cylindrical, but has a greater outer diameter than the lower portion 32 in order to define a shoulder that projects radially outward from the remainder of the inner member. A cylindrical upper portion 36 of the inner member 26 has a smaller outer diameter than the shoulder portion 34 and has external threading thereon with a suitable thread pattern for matable coupling with the internal threading of the box coupler 200 such that this threaded connection draws the annular bottom end of the box coupler 200 down against the topside of the inner member's shoulder 34, as shown in FIG. 2.

A hollow interior 38 extends into the inner member 26 from the bottom end 30 thereof and features an internally threaded section 40. In FIGS. 1 and 2, the hollow interior of the inner member of the first embodiment is shown as passing fully through the inner member in the axial direction, and the internally threaded section 40 starts at an axial distance from the bottom end 30 of the member 26 and is disposed in alignment with the external shoulder 34 of the member. However, in the first embodiment, the hollow interior 38 of the inner member need not necessarily reach fully through to the top end 28 of the inner member, and the internally threaded section 40 need not necessarily match up to the externally shouldered area 34 of the inner member. The internal threading 40 also need not necessarily start at an axial distance from the bottom end 30 of the inner member, and may start immediately at the bottom end instead of leaving a smooth-walled lower section 42 of the hollow interior intact below the intermediately-located threaded section 40.

The three-piece shear coupler 10 is completed by a shear member 44 in the form of an elongated stud whose central longitudinal axis lies coincident with those of the inner and outer members in the assembled shear coupler. The shear member 44 features upper and lower sets of external threading 46, 48 disposed on cylindrical top and bottom portions 50, 52 of the shear member that are separated in the axial direction by a shear neck 54 that has a reduced diameter relative to the remainder of the shear member 44 in order to defined a weakened area of reduced axial-load capability relative to the greater-diameter end portions 50, 52 of the shear member. The upper threading 46 at the top end of the shear member 44 is matable with the internal threading 38 of the inner member 26, and the lower threading 48 at the bottom end of the shear member 44 is matable with the internal threading of the reduced-diameter intermediate section 22 of the outer member's hollow interior 14.

The outer diameter of the upper external threading 46 of the shear member and the outer diameter of the cylindrical end sections 50, 52 of the shear member are less than the inner diameter of the smooth-walled lower portion 42 of the inner member's hollow interior 38, whereby the externally threaded top end of the shear member 44 can be passed upwardly into the hollow interior of the inner member 26 from the lower end thereof in order to thread the shear member 44 into engagement with the internal threading 40 of the inner member. The axial length of the shear member 44 is such that with its upper threads mated to the internal threading of the inner member, the shear member 44 reaches downwardly past the bottom end 30 of the inner member in order to support the shear member's lower set of external threads 46 outside the inner member 26 at an exposed position beyond the bottom end 30 thereof.

Before or after the above-described threading of the shear member 44 into the inner member 26, the box coupler 200 is threaded onto the externally threaded upper portion 36 of the inner member until the annular bottom end of the box coupler 200 abuts against the topside of the external shoulder 34 of the inner member, as shown in FIG. 2. At this point, with box coupler 200, inner member 26 and shear member 44 engaged together as an assembled unit, the lower cylindrical portion 32 of the inner member and the externally threaded lower portion 52 of the shear member 44 suspended therefrom are lowered into the upper section 20 of the hollow interior 14 of the outer member 12.

The external diameter of the lower cylindrical portion 32 of the inner member 26 is only slightly smaller than the internal diameter of the outer member 12 at the upper section 20 of its hollow interior so that the bottom end 30 of the inner member 26 can be lowered into the this upper section 20 of the outer member's interior 14 after the shear member 44 has been threaded into the inner member so as to be suspended therefrom, and the close fit between the nested portions of the inner and outer members acts to align the coincident axes of the shear member and the inner member with the longitudinal axis of the outer member 12. As a result, as the bottom end of the shear member 44 reaches the internally threaded intermediate section 22 of the outer member's interior 14, these elements are automatically aligned to allow engagement of their threads with one another by rotation of the assembled box coupler, inner member and shear member in the appropriate direction to advance the lower threading of the shear member 44 into the internal threading 22 of the outer member 12. Wrench flats (not shown) provided on the exterior box coupler, and/or on the shouldered section 34 of the inner member, may be used to drive the required rotation of the assembled unit in order to thread the shear member into engagement with the lower member.

Under sufficient advancing of this threaded connection at the intermediate section 22 of the outer member 12, the annular bottom end face 30 of the inner member 26 abuts against the annular stop face 56 that is defined by the right angle transition between the reduced-diameter intermediate section 22 of the outer member and its larger diameter upper section 20. At this point, the underside of the external shoulder 34 of the inner member also abuts against the annular top end 16 of the outer member. To accomplish this, the axial distance from the underside of the inner member's shoulder 34 to the bottom end 30 of the inner member 26 is equal to the axial distance from the top end 16 of the outer member to the flat top end 56 of the intermediate section 22 of the outer member's interior space 14. Receipt of the inner member this fully inserted position bottoming out in the upper section 14 of the outer member's hollow interior acts to complete the assembly of the shear coupler 10, as shown in FIG. 2.

The shear coupler 10 is thus ready for connection between two adjacent sucker rods during assembly of a sucker rod string, particularly by threading the internally threaded lower section 24 of the outer member onto the upper pin end 302 of one of two such sucker rods, and threading of the lower pin end of the upper one of the two sucker rods (not shown) into the top end of the box coupler 200.

With continued reference to FIG. 2, the shear member 44 has its top end threaded to the inner member, which in turn is coupled to the upper sucker rod by the box coupler 200. The lower end of the shear member 44 is threaded to the outer member 12, which is directly coupled to the lower sucker rod 300. The cylindrical walls of the upper section 20 of the outer member 12 and the lower portion 32 of the inner member 26 concentrically surround the reduced-diameter shear neck 54 of the shear member 44 that reaches down from the bottom end of the inner member 26 into engagement with the directly underlying threaded section 22 of the outer member's hollow interior 14. Application of an axial pulling force on the assembled sucker rod string that exceeds the axial load capability of the shear neck 54 will cause shearing of the same, thereby breaking the connection between the inner and outer members that was previously defined by the threaded engagement of the shear member 44 with the inner and outer members.

However, until such intentional shearing action is performed, the concentric cylindrical nesting of the inner and outer members closely together around the shear member 44, and clamping of the shoulder 34 of the inner member 26 tightly against the top end 16 of the outer member 10, provides improved torque handling capability over prior art designs where the shear-neck is provided beneath the head of a pin coupler, in which case the only additional torque handling material other than the shear neck itself is the surrounding wall of the box coupler 200. With reference to FIG. 2, it can be seen that with the present invention, the collective radial distance spanned by the concentrically nested portions of the inner and outer members that close around the shear member exceeds the radial span of the conventional box coupler 200, thus providing improved torque strength to the shear coupler over such prior designs.

Figure 3:
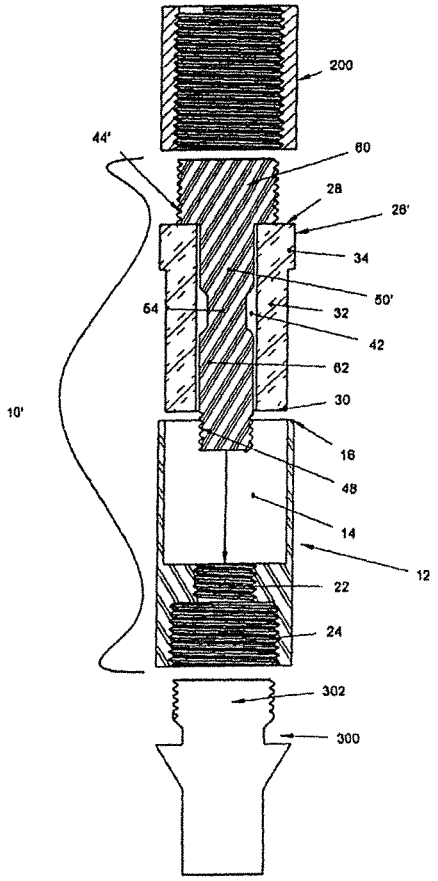
FIG. 3 is a partially exploded view similar to FIG. 1, but of a shear coupler according to a second embodiment of the present invention.
Figure 4:
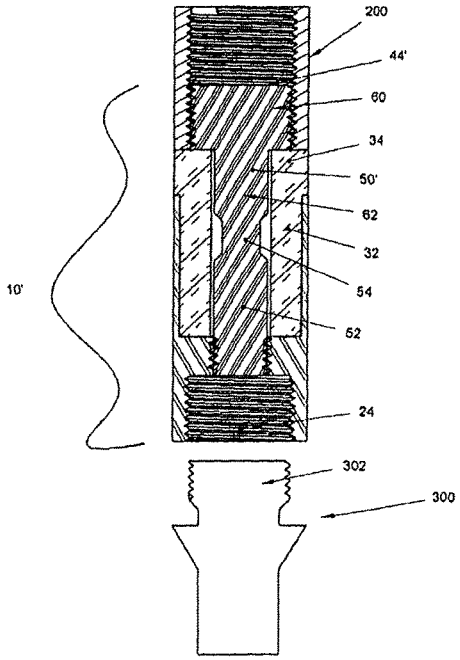
FIG. 4 is an assembled view of the shear coupler of FIG. 3.

FIGS. 3 and 4 show a second embodiment shear coupler 10' that features the same outer member 12 as the first embodiment, but differs somewhat in the design of the inner member 26' and the shear member 44'. Particularly, the shouldered area 34 of the inner member 26' defines the top end 28 of the inner member, which thus lacks an externally threaded pin at its upper end. Instead, the shear member 44' features an externally threaded head 60 attached at the top end of the stud shaft 62 to define a male pin end of the shear member 44'. The shear member 44' is preferably a single, unitary body of material in which the stud shaft 62 and the head 60 are seamlessly integral with one another. The upper cylindrical portion 50 of the stud shaft 62 is left unthreaded, unlike the first embodiment, due to inclusion of external threads on the head 60 of the shear member 44' instead.

The head 60 of the shear member 44' has a diameter that is greater than the stud shaft 62, and greater than the diameter of the hollow interior of the inner member at the top end 28 thereof, but less than the outer diameter of the shoulder 34 at the top end 28 of the inner member. In the second embodiment, the hollow interior of the inner member 26' must span the full axial length of the inner member in order to define an axial passage therethrough from the top end 28 of the bottom end 30. The external threading on the head 60 of the shear member 44' is configured for mating engagement with the internal threads at the bottom end of the box coupler 200.

The second embodiment differs in assembly from the first embodiment in that instead of feeding a headless stud-shaped shear member 44 upwardly into the bottom end 30 of the inner member, the stud shaft 62 of a head-equipped shear member 44' is inserted downwardly through the hollow interior of the inner member 26' from the top end 28 thereof. The axial length by which the stud shaft 62 projects from the head 60 exceeds the axial length of the inner member 26' between its top and bottom ends 28, 30, whereby the externally threaded lower portion 52 of the stud shaft 62 reaches downwardly past the bottom end 30 of the inner member when the shear member 44' is inserted fully into the inner member, whereupon the flat annular face or shoulder at the underside of the head 60 is seated against the top end 28 of the inner member.

With the shear member received in this fully inserted position in the inner member, the box coupler 200 is threaded onto the externally threaded head 60 of the shear member 44' until the bottom end of the box coupler 200 abuts against the top end 28 of the inner member at the portion of the topside of the shoulder 34 that reaches radially outward beyond the head 60 of the shear member 44'.

Like in the first embodiment, the unit formed by the assembled box coupler, inner member and shear member is inserted into the hollow interior of the outer member, and then rotated in order to engage the lower set of external threads 48 on the shear member 44' with the internally threaded intermediate section 22 of the outer member's hollow interior 14, thereby completing the assembly of the shear coupler 10', which is now ready for respective coupling to two suckers rods at the top end of the box coupler 200 and the bottom end of the outer member 12.

In an unillustrated variant of the second embodiment, instead of relying on connection of the box coupler 200 to the head 60 of the shear member 44' to rotationally lock the shear member to the inner member so that driven rotation of the inner member or box coupler 200 will drive rotation of the shear member and engage the shear member's lower threads 48 with the internal threads 22 of the outer member, the shear member and inner member may be cooperatively keyed or splined at the upper portion 50 stud shaft 62 and the upper end 28 of the inner member 26' so that insertion of the shear member in an orientation properly aligning the cooperating key or spline features about the coincident longitudinal axes of the shear member and inner member will rotationally lock these components together by blocking relative rotation between them. In such instance, the keyed-together shear member and inner member may be inserted into the lower member 12 prior to the addition of the box coupler 200 to the threaded head 60 of the shear member 44'.

Figure 5:
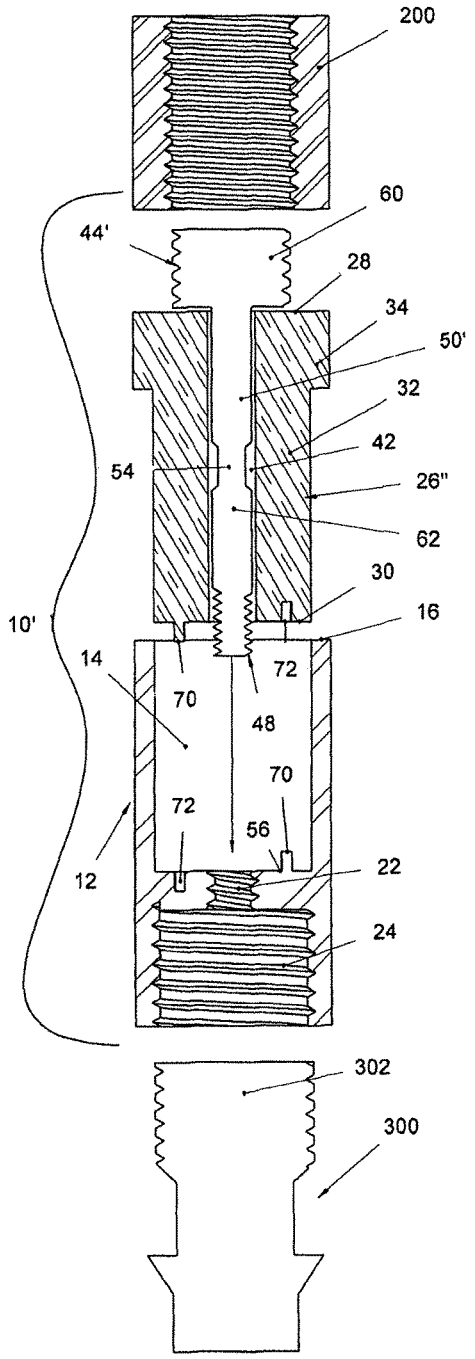
FIG. 5 is a partially exploded view similar to FIG. 3, but showing a slight variant of the second embodiment.
Figure 6:
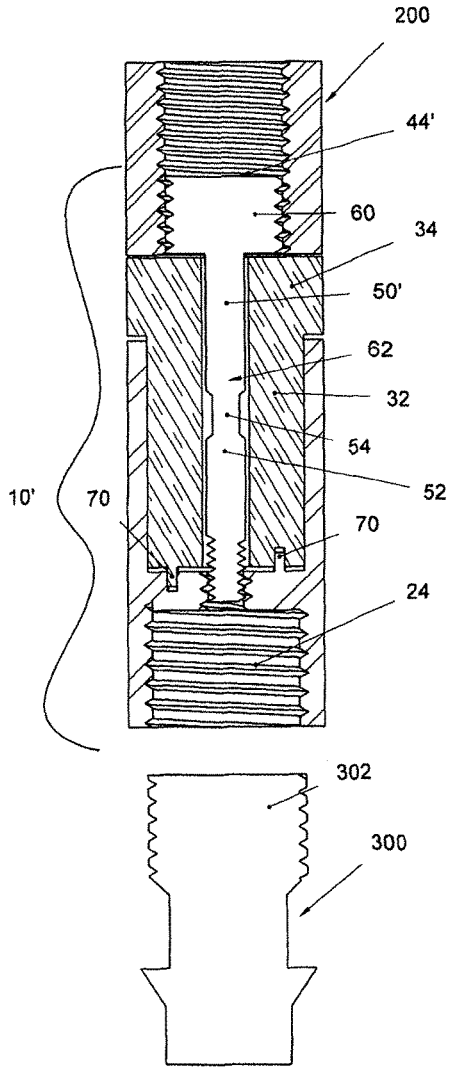
FIG. 6 is an assembled view of the shear coupler of FIG. 5.

In another variant of the second embodiment, which is shown in FIGS. 5 and 6, one or more pairs of mating features 70, 72 are defined on the annular topside 56 of the intermediate section 22 of the outer member 12 and on the annular bottom end 30 of the inner member. Each such pair features a male projection 70 extending axially from one of these two surfaces, and a female notch, slot or recess 72 in the other of these two surfaces. The male projections 70 fit into the female recesses 72 under axial sliding of the inner member 26" into the fully inserted position in the outer member. In this particular configuration, the inner member can be fully inserted into the outer member prior to receipt of the shear member 44 in the inner member 26", at which point the mating together of the cooperating male and female features 70, 72 blocks relative rotation between the inner and outer members in order to rotationally lock the same together in the assembled shear coupler.

The shear member 44' is then inserted into the inner member in order to lower the bottom end of the shear member 44' down to the internally threaded section 22 of the outer member's interior, at which point the shear member is rotated in the thread advancing direction in order to draw the shear member 44' into its fully inserted position in which its head 60 abuts against the top end 28 of the inner member 26". The box coupler 200 may be threaded onto the head 60 of the shear member 44' before or after the insertion of the shear member through the inner member and into threaded engagement with the outer member. The head 60 of the shear member 44' may be equipped with wrench flats to allow rotational driving thereof into fully threaded engagement with the outer member's intermediate section 22 before installation of the box coupler 200 thereon. As is known in the art, such a box coupler 200 will likewise typically feature wrench flats for driven rotation of same during threaded assembly of the sucker rod string.

Instead of male and female features 70, 72 that mate together at the lower end of the inner member 26, the inner surface of the outer member's circumferential wall and the outer surface of the inner member's circumferential wall may employ cooperating spline or key elements that extend axially therealong for mating together of these elements under sliding insertion of the inner member 26" to the outer member in order to rotationally lock the two together. However, the use of the illustrated mating features 70, 72 avoids reduction of the circumferential wall thickness of either member at keyway slots or female splines formed therein.

In a variant of the first embodiment in FIG. 1, the use of a box coupler above the inner member may be avoided by instead configuring the upper portion of the inner member 26 to feature an internally threaded female box end that couples directly to the bottom pin of the sucker rod located above the shear coupler.

In the first two illustrated embodiments, the outer diameters of the shouldered area 34 of the inner member 26, 26' and the exterior of the outer member 12 are preferably of diameter equal to, or at least no greater than, the conventional box coupler 200 used at the top end of the shear coupler so as not to increase the size of the resulting joint between the two sucker rods relative to a non-shearable joint defined by the box coupler alone.

To decrease wear to the surrounding production tubing by possible contact with the joint formed by the shear coupler 10, the outer member of either the first or second embodiment may be equipped with a tubular wear member rotatably disposed therearound and retained in place by the lower sucker rod 300 in a manner described in Applicant's U.S. provisional patent application No. 61/945,010, filed Feb. 26, 2014, or Applicant's U.S. provisional patent application No. 61/948,746, filed Mar. 6, 2014, both of which are incorporated herein by reference in entirety.

The inner member 26 of the first embodiment shown in FIGS. 1 and 2, may be additionally or alternatively equipped with a tubular wear member rotatably situated therearound by reconfiguring the upper externally threaded portion 36 or pin end of the inner member in the manner disclosed in the incorporated references to include two reduced diameter portions smaller than the shoulder 32 at a location between the shoulder and the pin end 36 of the inner member in order to receive of a tubular wear member and a retention sleeve for same, which are then retained in place by attachment of the box coupler 200.

Figure 7:
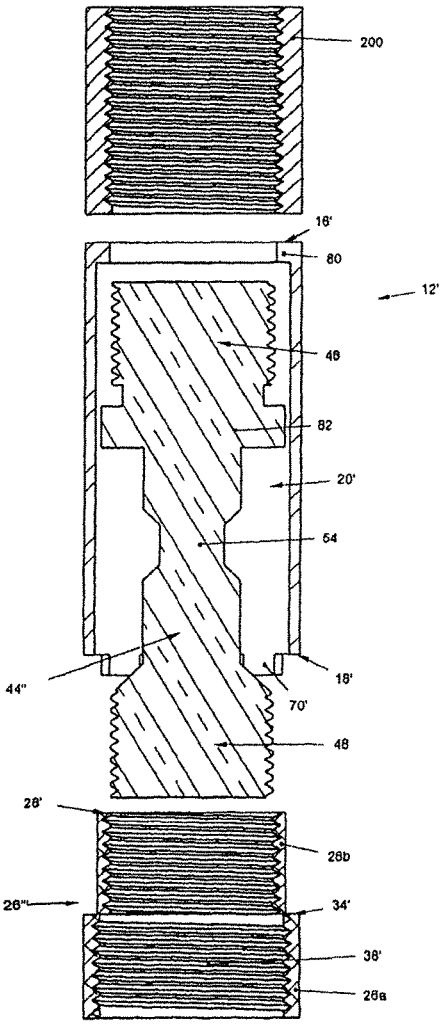
FIG. 7 is a partially exploded view of a third embodiment shear coupler.

FIG. 7 shows a third embodiment shear coupler 10" in which the inner member 26" is positioned below the outer member 12'. The outer member's hollow interior 20' is entirely smooth-walled with no internal threading, and the opening by which part of the inner member 26" is insertable into the outer member 12" is now at the bottom end 18' of the outer member 12'. An internal shoulder 80 juts inwardly from a uniform-diameter cylindrical remainder of the outer member's interior at the top end 16' of the outer member.

The inner member 26'" is again stepped in outer diameter like that of the preceding embodiments, but this time having a lower portion **26*a* of larger inner and outer diameter than an upper portion 26*b* disposed thereatop. This creates an external annular shoulder or stop face 34' that faces upwardly toward the top end 28' of the inner member at the transition between the two different external diameters of the member 26'". The smaller diameter upper portion 26*b* of the inner member is sized to slide axially into the corresponding open end 18'** of the outer member when in concentric alignment therewith, like in the other preceding embodiments.

The hollow interior 38' of the inner member 26'" passes fully therethrough in the axial direction, with larger diameter internal threading inside the lower portion **26*a* for threaded engagement with the pin end of a lower sucker rod disposed below the coupler, and smaller diameter internal threading inside the upper portion 26*b* for threaded coupling with the lower set of external threading 48 on the shear member 44". The internally threaded configuration of the inner member 26'" in this embodiment thus matches the internal threading configuration of the outer member 12 of the preceding embodiments, but without a smooth-walled larger diameter interior portion located above the threaded portions 26*a*, 26*b*** that engage the lower sucker rod and the shear member.

Like in the second embodiment, the upper set of external threading 46 on the shear member 44" is of larger diameter than the lower set of threading 48, and is configured to mate with the internal threading of a conventional box coupler 200. However, the outer diameter of the upper threading 46 is smaller than the inner diameter of the internal shoulder 80 of the outer member, and thus also smaller in diameter than the remainder of the outer member's hollow interior. An external shoulder 82 on the shear member 44" is located between the shear neck 54 and the upper threading 46 of the shear member, and extends radially outward from a remainder of the shear member. The lower external threading 48 of the shear member 44" is of smaller diameter than the upper threading 46.

Figure 8:
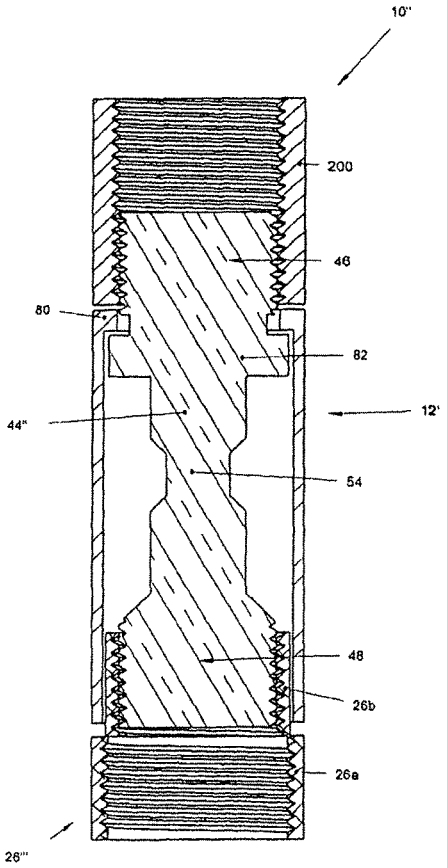
FIG. 8 is an assembled view of the shear coupler of FIG. 7.

To assemble the third embodiment coupler 10", first the lower threads 48 of the shear member 44" are engaged into the internal threading of the smaller diameter upper portion **26*b* of the inner member 26'" through the open top end thereof. Then the outer member 12' is lowered into place over the shear member 44", until the internal shoulder 80 of the outer member 12' comes into rested abutment against the topside of the external shoulder 82 of the shear member 44". This also acts to bring the bottom end 18' of the outer member 12' into abutment against the outside shoulder 34' of the stepped-diameter inner member 26'", as shown in FIG. 8**.

Mating male and female features are defined at the lower end of the outer member 12' and the shoulder 34' of the inner member 26'" in order to fit together and prevent relative rotation between the inner and outer members in the assembled shear coupler, whereby the mated inner and outer members can transmit torque across the shear coupler. FIG. 7 shows integral male tabs 70' projecting axially from a remainder of the bottom end face of the outer member in order to fit into cooperating female slots or notches (not shown) that are cut into the shoulder 34' of the inner piece at matching intervals around the longitudinal axes of the members. This mating together of the tabs and notches provides the rotational-locking function between the inner and outer members.

With the inner and outer members mated together in this manner, the externally threaded upper end or head of the shear member 44" that is disposed above the external shoulder 80 reaches upwardly through the opening at the internally shouldered top end 16' of the outer member 12', whereupon a conventional box coupler 200 can be threaded onto these upper threads 46 of the shear member 44" and thereby brought into abutment against the internally shouldered top end 16' of the outer member 12'. This completes the assembled state of the shear coupler 10" shown in FIG. 8, where the internally threaded bottom portion **26*a* of the inner member 26'" is ready to receive the top pin end of the lower sucker rod at the bottom end of the shear coupler, and the box coupler 200** at the top end of the shear coupler is likewise ready to receive the bottom pin end of the upper sucker rod to be installed above the shear coupler in the assembled sucker rod string.

Figure 9:
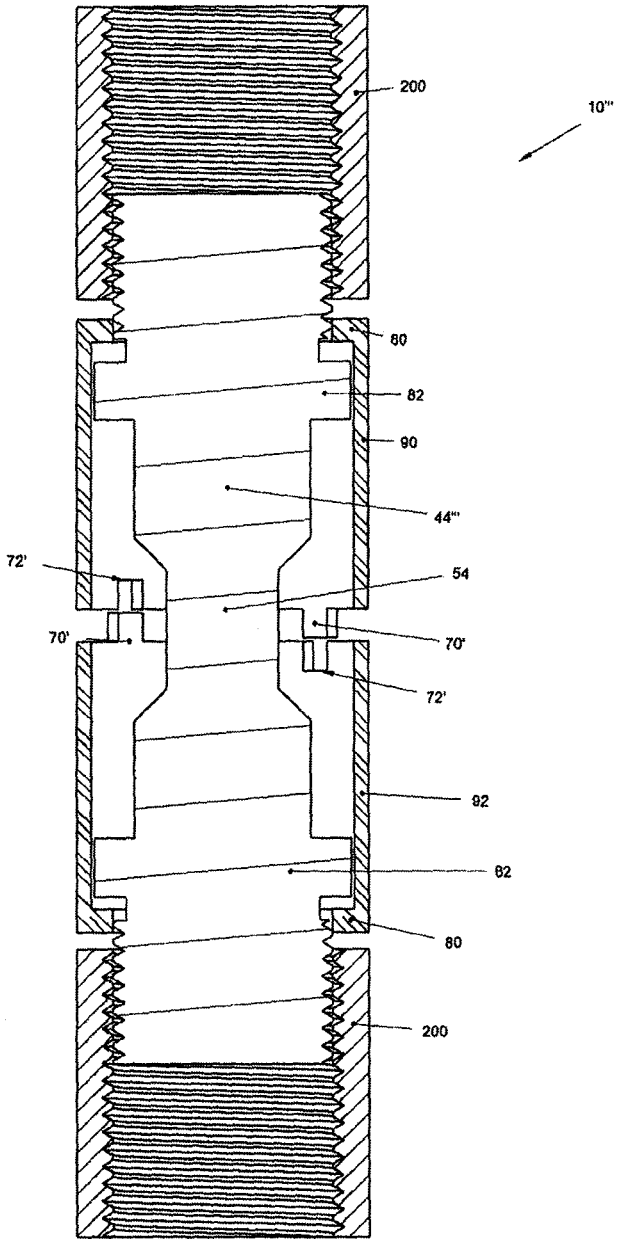
FIG. 9 is an assembled view of a fourth embodiment shear coupler.
Figure 10:
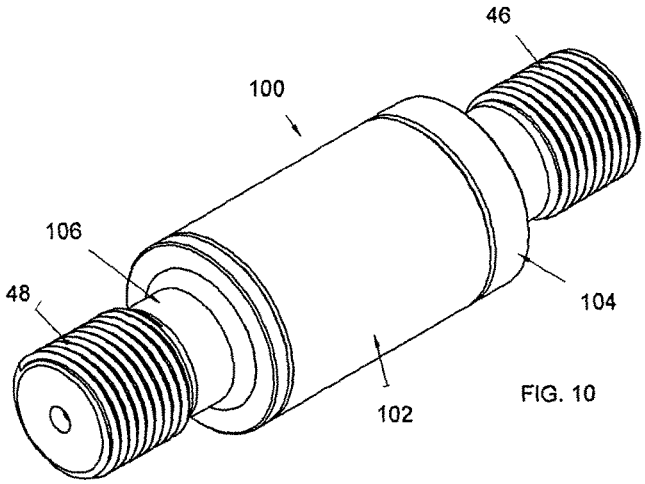
FIG. 10 is an assembled perspective view of a fifth embodiment shear coupler.

FIG. 9 shows a fourth embodiment shear coupler 10'" in which both ends of the shear member 44'" are configured identically to one another, particularly with matching external threading 46, 48 that is suitably dimensioned for mating with the internal threading of a respective conventional box coupler 200, and a respective external shoulder 82 defining a respective enlarged area of the shear member 44'" between the one of the two sets of threads 46, 48 and the centrally located shear neck 54 of this symmetric shear member design. In this embodiment, while there are still two hollow members 90, 92 with hollow interior's that receive respective portions of the shear member 44'" in the assembled coupler, the hollow members 90, 92 no longer nest one inside the other, but instead abut axially against one another end-to-end with the cylindrical exteriors of the two hollow members 90, 92 lying flush with one another around their coincident longitudinal axes. Like the outer member 12' of the third embodiment, each hollow member 12 features an internal shoulder 80 jutting inward at a respective end of the hollow member that lies opposite an unshouldered open end thereof through which the shear member 44'" is inserted. The upper hollow member 90 features this internal shoulder 80 at the upper end of its otherwise uniform-diameter interior, while the lower hollow member 92 features its internal shoulder 80 at the lower end of its otherwise uniform-diameter interior.

The upper and lower members 90, 92 feature pairs of mating male tabs 70' and female slots or notches 72' which extend and recess axially from and into the lower end of the upper hollow member 90 and the upper end of the lower member 92. As a result, bringing the two members 90, 92 together axially into end-to-end abutment in proper alignment around their coincident longitudinal axes acts to matingly insert the male tabs 70' into the female notches 72' in order to prevent rotation of the two members' relative to one another about their longitudinal axes. Accordingly, like the inner and outer members of the third embodiment, the hollow members 90, 92 are rotationally locked together in order to transmit torque across the shear coupler during driven rotation of the sucker rod string.

To assemble the fourth embodiment shear coupler, the externally threaded lower end of the shear member 44'" is lowered into the interior of the hollow lower member 92 through the unshouldered open top end thereof until the lower one of the two external shoulders 82 on the shear member 44'" abuts against the internal shoulder 80 of the hollow lower member 92, at which point the threaded lower extremity of the shear member 44'" projects axially outward from the hollow interior via the shouldered, open bottom end of the lower member. A conventional box coupler 200 is threaded onto this exposed lower threading of the shear member outside the hollow lower member 92, until the top end of the box coupler 200 abuts against the internally shouldered bottom end of the lower member 92, thus clamping the lower member 92 against the lower shoulder 82 of the shear member.

A similar assembly step is repeated at the top end of the shear member 44, particularly by lowering the unshouldered, open lower end of the hollow upper member 90 downwardly over the top end of the shear member 44'" until the internal shoulder 80 of the hollow upper member 90 rests atop the upper shoulder 82 of the shear member 44' with the male and female tabs 70' and notches 72' mated together at the now-abutting unshouldered ends of the two hollow members 90, 92. This leaves the upper threading 46 of the shear member 44'" exposed outside of the two hollow members at a location beyond the shouldered top end of the upper hollow member 90. Here, a respective box coupler 200 is threaded onto the shear member 44'" in order to force the internal shoulder 80 of the upper hollow member 90 down against the upper external shoulder 82 of the shear member, thus clamping the upper hollow member 90 to the shear member 40 and likewise holding the two hollow members 90, 92 together in their axially mated, rotationally locked positions. This completes the assembly of the shear coupling 10'", whereupon it is ready to be coupled between the pin ends of two adjacent sucker rods via the two box couplers 200 of the assembled shear coupler.

FIGS. 10 through 17 illustrate a fifth embodiment shear coupler 100 that, like the third and fourth embodiments, features two members 102, 104 externally disposed around a shear member 106 that has a reduced-diameter neck 54 at a longitudinally intermediate position disposed centrally between two externally threaded male pin ends of the shear member 106. One of the members disposed around the shear member is a hollow sleeve member 102 that closes around the weakened shear neck 54 at the longitudinal center of the shear member, similar to the outer member 12' of the third embodiment and the two hollow members 90, 92 of the fourth embodiment. The sleeve 102 has a cylindrical exterior, and an axial length greater than its outer diameter. The second member disposed around the shear member is also a hollow member with a central opening extending axially therethrough, but has a notably smaller axial length than the sleeve 102, for example having an axial length that is less than both its interior and exterior diameters. Accordingly, this second member 104 is more of a flat ring than an elongated sleeve.

Unlike the third and fourth embodiments where axially mating tabs and recesses rotationally lock the hollow members to one another, the hollow sleeve member 102 of the fifth embodiment is instead rotationally interlocked with the shear member 106 in a direct fashion, as described in greater detail below.

Figure 12:
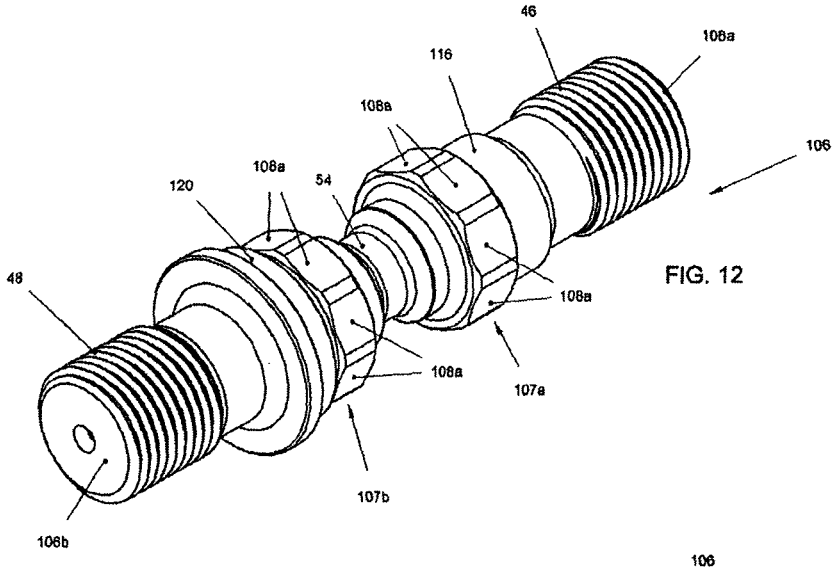
FIG. 12 is a perspective view of a shear member of the shear coupler of FIG. 10 in isolation.
Figure 13:
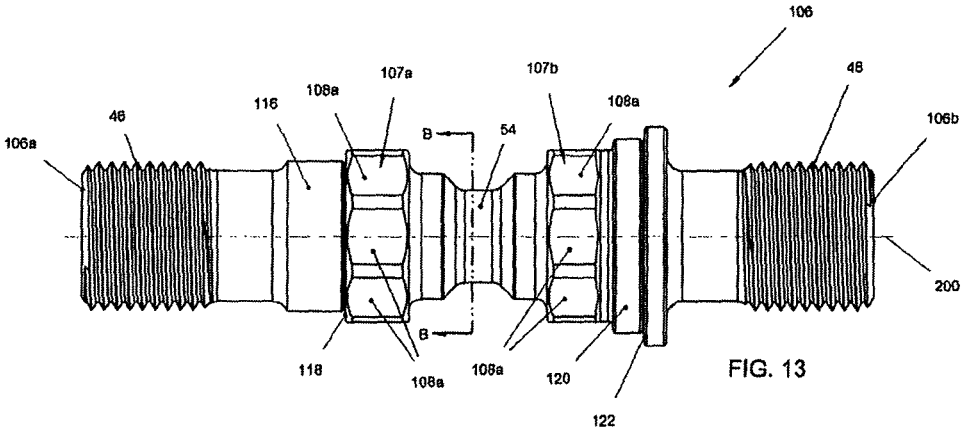
FIG. 13 is a side view of the shear member of FIG. 9.
Figure 14:
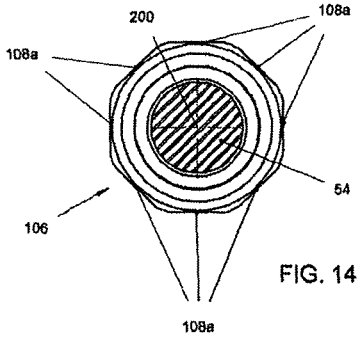
FIG. 14 is a cross-sectional view of the shear member of FIG. 13 as taken along line B-B thereof.

With reference to FIGS. 12 to 14, a respective rotational locking area 107*a*, 107*b* is defined on the shear member on each side of the weakened shear neck area 54, and has a flat sided generally polygonal configuration featuring a plurality of flat faces or facets 108*a* joined end to end with one another around the circumference or outer periphery of the shear member 106. The diameter of the shear member 106 at both of these rotational locking areas 108, as measured between a parallel pair of diametrically opposing facets thereof, is the same. This diameter at the rotational locking areas 107*a*, 107*b* is greater than the diameter of the shear neck 54, and also greater than the major crest-to-crest thread diameter at the two matching pin ends of the shear member 106. Each rotational locking area 107*a*, 107*b* located between the shear neck 54 and a respective end of the shear member thus defines an area of flat-sided outer peripheral shape and an enlarged diameter relative to the shear neck 54 and respective pin end.

Figure 15:
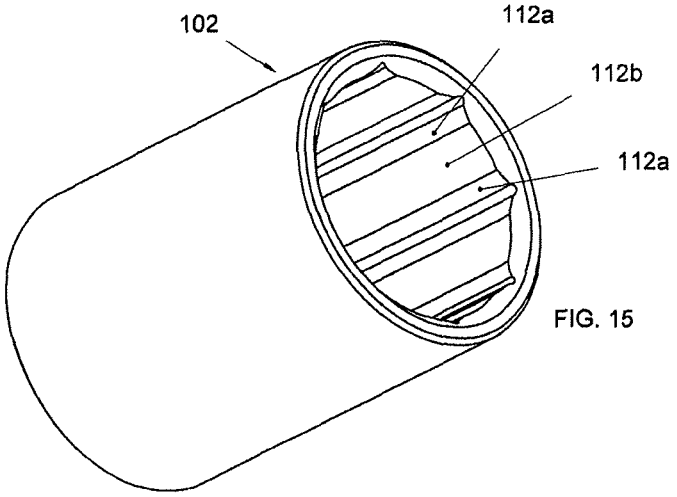
FIG. 15 is a perspective view of a hollow sleeve member of the shear coupler of FIG. 10 in isolation.
Figure 16:
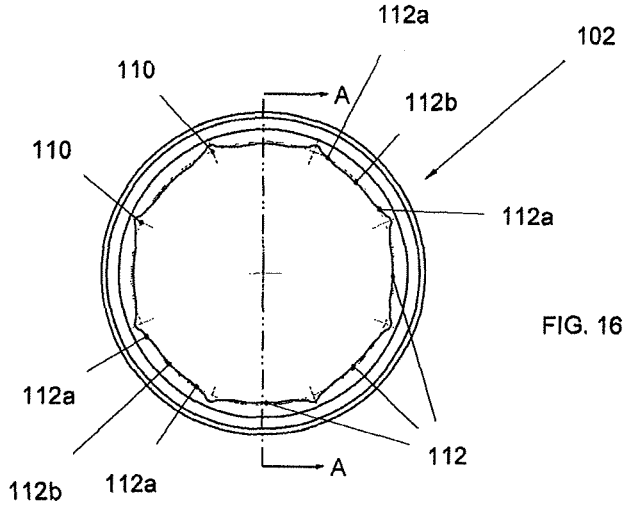
FIG. 16 is an end view of the hollow sleeve member of FIG. 15.
Figure 17:
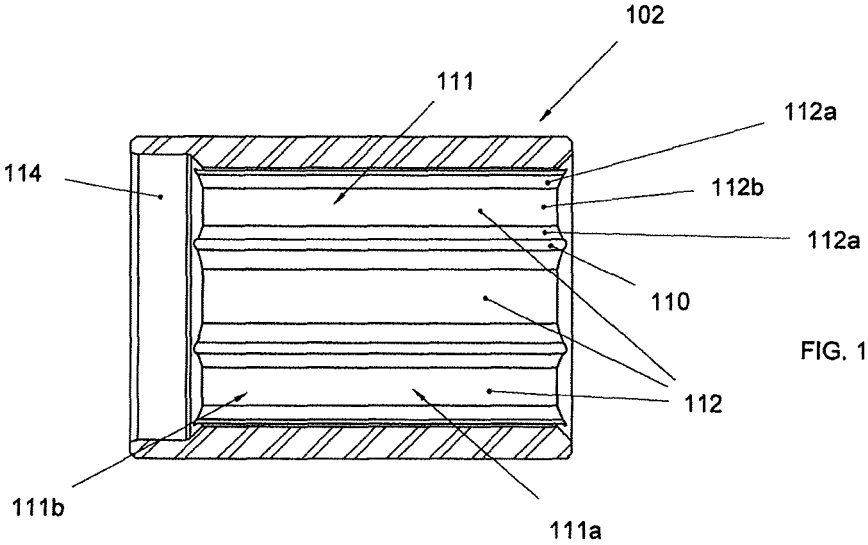
FIG. 17 is a cross-sectional view of the hollow sleeve member of FIG. 16, as viewed along line A-A thereof.

Turning to FIGS. 15 through 17, the interior of the sleeve 102 does not have the purely cylindrical form of the sleeve's exterior. Instead, over a substantial majority of the sleeve's axial length, the sleeve's interior has a generally polygonal configuration 111 in cross-sectional planes lying normal to the longitudinal axis of the sleeve. The generally polygonal shape of the sleeve's interior corresponds to the generally polygonal cross-sectional shape of the rotation locking areas 107*a*, 107*b* of the shear member. In the illustrated embodiment, the generally polygonal inner peripheral shape of the sleeve and the generally polygonal outer peripheral shape of the shear member are octagonal, but the selected polygonal shape may vary.

The corner edges 110 between the eight sides 112 of the sleeve's generally octagonal inner shape are radiused inside corners, and each side has two coplanar facets 112*a* residing adjacent the opposite corners of the side and a shallow scallop or arcuately curved recess 112*b* between the two facets. The generally polygonal configuration of the sleeve's interior starts at one end thereof, but stops short of the opposing end, where the interior is completed by a cylindrically enlarged bore 114 of greater diameter than the polygonal portion of the sleeve's interior.

Starting from a first one of the rotational locking areas 107*a* and moving toward a corresponding first end 106*a* of the shear body on the same side of the shear neck 54, the diameter of the shear body steps down to create a first cylindrical seating area 116 for receiving the ring member 104, thereby also creating a first exterior shoulder 118 that faces toward the first end 106*a* of the shear member at the transition between the first rotational locking area 107*a* and the first seating area 116. On the other side of the shear neck 54, starting from the second rotational locking area 107*b* and moving toward the second end 106*b* of the shear member 106, the diameter of the shear body steps up to a second cylindrical seating area 120 for receiving the cylindrically bored end 114 of the hollow sleeve 102. Continuing toward the second end 106*b* of the shear member 106, the diameter of the shear member steps up again to create a second external shoulder 122 of the shear member that also faces toward the first end 106*a* of the shear member 106. The diameter of the shear member is at its greatest at this second shoulder 122, where the diameter of the shear member exceeds the internal diameter of the bored-out end 114 of the sleeve 102 and is equal to the outer diameter of the sleeve 102.

Figure 11:
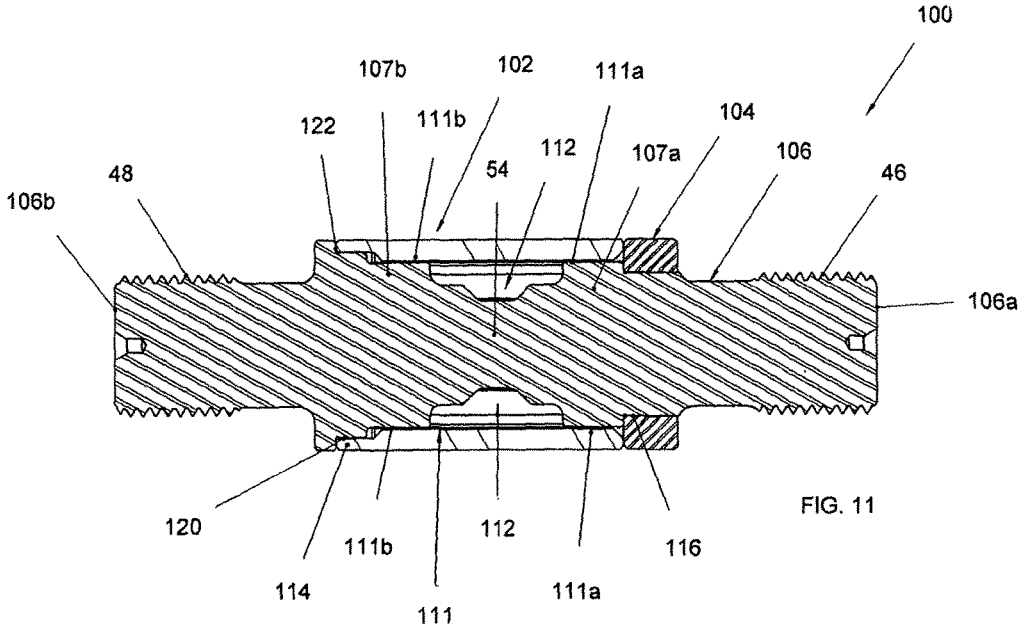
FIG. 11 is a cross-sectional view of the shear coupler of FIG. 10, as cut along a longitudinal axis thereof.

With reference to FIG. 11, the shear coupler 100 is assembled by first sliding the bore-out end 114 of the sleeve over the first end 106*a* of the shear member 106, and with the sides of the generally polygonal interior of the sleeve in facing-together alignment with the facets of the generally polygonal exterior of the shear member, the sleeve is pushed further onward toward the second end 106*b* of the shear member 106 until the bored-out end 114 of the sleeve 102 abuts the second external shoulder 122 of the shear body. This defines the fully installed position of the sleeve, in which it surrounds the weakened shear neck 54 of the shear member 106. The radiused corners and scalloped sides of the sleeve's interior eases the process of sliding sleeve onto the shear member by providing clearance spaces between the sleeve and the shear member. The radii also reduce stress concentrations when torque is transmitted from the upper end of the shear member to the lower end of the shear member. In the installed position, the flat facets 112*a* on the interior of the sleeve lie in flush contact with the flat facets 108*a* of the exterior of the shear body at the rotational locking areas 107*a*, 107*b* thereof. This way, the sleeve is rotationally interlocked with the shear body for rotation therewith.

Preferably the diameter of the cylindrically bored end portion 114 of the sleeve's interior is machined to a pre-assembly value that is slightly less than the pre-assembly diameter of the second seating area 120 of the shear member so that the sleeve is fitted onto the shear member in a press-fit condition at this area, thereby contributing to maintenance of the sleeve's installed position in the axial direction and to the rotational locking of the sleeve to the shear member. Between the cooperatively shaped polygonal portions of the sleeve and shear member and the interference fit between the cylindrically bored end of the sleeve interior and the second seating area of the shear member, any rotation between the sleeve and shear member is effectively prevented. In one embodiment, the diameter of the polygonal portion of the sleeve's interior, measured between the plane of the flat facets at one side of the polygon to the plane of the flat facets at a diametrically opposing side of the polygon, is slightly greater than the facet-to-facet diameter of the rotational locking areas of the shear member in order to provide a clearance fit between the facets of the two parts. In another embodiment, the diameter of the polygonal portion of the sleeve's interior is slightly smaller than that of the rotational locking areas of the shear member in order to provide an interference fit between the facets, thereby further contributing to the press fit condition of the sleeve on the shear member. The tolerance stackup of the fit between the polygonal peripheries of the sleeve and shear member may encompass both interference and clearance conditions, thereby providing a transition fit between them.

To complete the assembly, the ring member 104 is slid over the first end 106*a* of the shear member and press-fitted onto the first seating area 116 of the shear member in abutment against the first external shoulder 118 and the corresponding end of the sleeve 102. This way, the ring 104 defines a stop ring that axially secures the sleeve 102 in its installed position abutted against the second external shoulder 122 of the shear member 106. Through the rotational locking of the sleeve to the shear member by the cooperating interior and exterior geometries (and the press fit between the shear member and sleeve, if employed), and together with the axial locking of the sleeve in place by the stop ring 104, the sleeve is effectively united with the shear body in a manner contributing to transfer of torque across the weakened shear neck 54 during rotation of the coupler as part of a sucker rod string. As described for other embodiments above, the assembled shear coupling is now ready for assembly into a rotationally driven sucker rod string using conventional box couplers at the two pin ends of the shear member that project from the opposing ends of the sleeve.

In an unillustrated variant of the fifth embodiment, the stop ring 104 and corresponding seating area 116 may be omitted, and the box coupler 200 instead threaded onto the first pin end 106*a* of the shear member 106 into a position abutting the end of the sleeve 102 nearest the end 106*a* of the shear member to axially hold the sleeve in its installed position. In another variant, the male pin at the second end 106*b* of the shear member may be replaced with an internally threaded female box end for direct coupling to the pin end of a sucker rod, instead of indirect coupling thereto via a box coupler. While the fifth illustrated embodiment uses generally polygonal shapes for the cooperative rotational-locking geometries of the sleeve and shear member, it will be appreciated that other peripheral shapes capable of preventing relative rotation between the two may alternatively be employed. However, use of a regular polygon allows for easier alignment between the sleeve and the shear during assembly, as alignment of any one side of the sleeve's polygonal shape with any one of side of the shear member's polygonal shape will automatically serve to align all the other sides as well. Although not illustrated herein, seals may be employed between the sleeve and the shear member on both sides of the weakened area of the shear member, thereby protecting same against corrosive fluids during use of the coupler in the well, for example using the seal arrangement disclosed in U.S. Pat. No. 4,411,546, which is incorporated herein by reference.

In the third and fourth embodiments, the axially mating tabs and recesses used sides the tabs and recesses that abut face-to-face in a circumferential direction to block relative rotation between the components on which the tabs and recesses are formed, whereas the cooperating peripheral geometries in the fifth embodiment have their facet surfaces abutted face-to-face in a radial direction to provide the same rotational-locking function between the components concerned. While the third and fourth embodiments used this rotational interlock between two hollow members disposed around the shear member, such embodiments could be modified to instead define the tab/recess interlock between a hollow sleeve and the shear member itself. For example, with reference to the third embodiment of FIGS. 7 and 8, the inner hollow member 26''' with a female box end for receiving the male pin end of a sucker rod and slots for receiving the tabs of the outer hollow member 12' could be made an integral part of the shear member, whereby the axial tabs outer hollow member 12' would mate with axial slots in the shear member.

With its two rotational locking areas 107*a*, 107*b* disposed on opposite sides of the shear neck 54, and with the hollow sleeve 102 retained in non-threaded relation to the shear body 106 between the stop ring 104 and the second external shoulder 122, the fifth embodiment 100 substantially isolates the tensile and torsional loads of the from one another. That is, the shear neck 54 itself carries 100% of the axially-acting tensile load and handles only a small percentage of the torque, while the hollow sleeve 102 carries none of the tensile load and handles a large percentage or substantial majority of the torque. This denotes a significant change to the load handling characteristics of prior art designs, in which the compound effect of significant tensile and torsional loads on the same component may contribute to a shorter fatigue life. Further potential benefits of the use of rotational locking features on both sides of the shear neck and stop-ring axial retention of the hollow sleeve are described below with reference to further embodiments shown in FIGS. 18 to 21.

Figure 19:
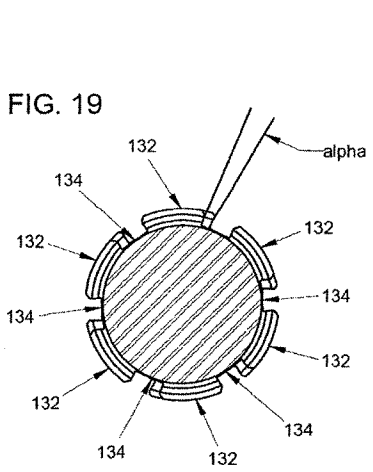
FIG. 19 is a cross-sectional view of the shear member of FIG. 18, as viewed along line A-A thereof.
Figure 18:
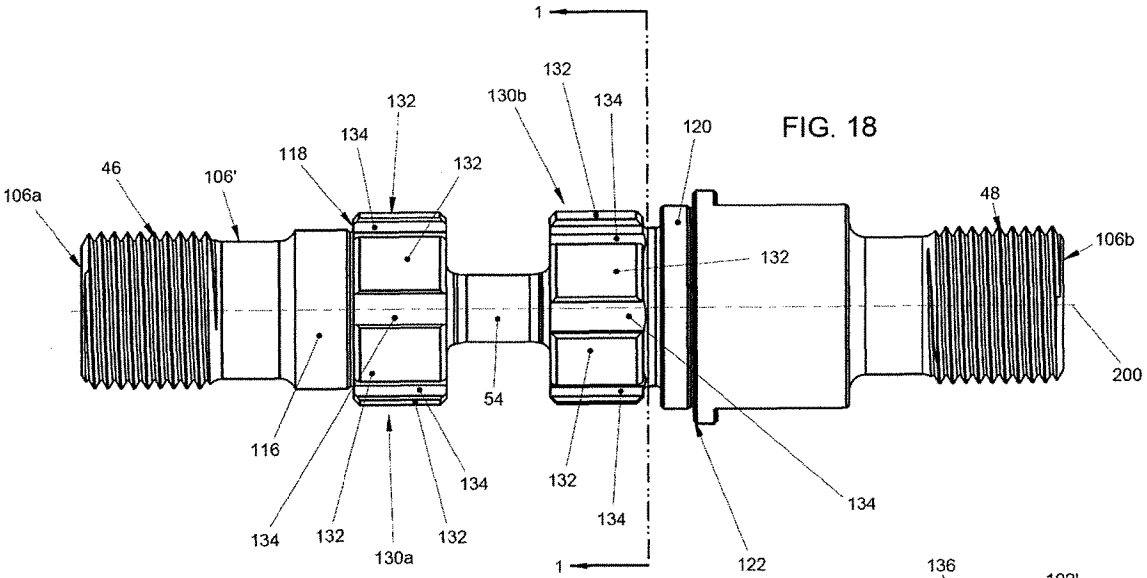
FIG. 18 is assembled side view of a shear member of a sixth embodiment shear coupler.

FIGS. 18 and 19 illustrate a shear body 106' of a sixth embodiment coupler of the present invention, which like that of the fifth embodiment, features first and second pin ends 106*a*, 106*b* spaced apart in the longitudinally axial direction, a reduced diameter shear neck 54 positioned at a longitudinally intermediate location between the pin ends, first and second rotational locking areas 130*a*, 130*b* situated on opposite sides of the shear neck 54, a first seating area 116 at a first external shoulder 118 located between the first rotational locking area 130*a* and the first pin end 106*a* of the shear body, and a second seating area 120 at a second external shoulder 122 located between the second rotational locking area 130*b* and the second pin end 106*b* of the shear body. The sixth embodiment differs from the fifth embodiment in that the rotational locking areas 130*a*, 130*b* employ a splined profile instead of a polygonal profile, and in that the profiles of the two rotational locking areas 130*a*, 130*b* are angularly offset from one another about the longitudinal axis 200 of the shear body 106'.

The illustrated embodiment employs a parallel key spline configuration at each of the rotational locking areas of the shear body, and also at a corresponding internal spline profile of the hollow sleeve 102' (which is shown separately in FIGS. 22 to 25). At each rotational locking area 130*a*, 130*b* of the shear body 106', a series of identical arc-shaped keys 132 are integrally defined on the periphery of the shear body at equally spaced apart locations around the longitudinal axis 200 thereof. The keys 132 of each rotational locking area are separated from one another around the longitudinal axis 200 by a corresponding series of identical rectangular keyways 134, thereby defining the parallel key spline configuration. The interior of the hollow sleeve 102' has a splined internal profile which spans a substantial majority of the sleeve's axial length, like the generally polygonal internal profile of the fifth embodiment sleeve. Once again the sleeve 102' terminates at a cylindrical end portion 114 of the sleeve interior for fitting over the corresponding seating area 120 of the shear body. The sleeve's splined internal profile features a series of identical rectangular keys 136 integrally defined on the sleeve and projecting radially into the axial through-bore of the sleeve 102' at equally spaced positions around the longitudinal axis 200 that is shared by the sleeve and shear body when mated together. The rectangular keys of the sleeve are equal in number to the keyways at each of the rotational locking areas of the shear body, and are axially slidable into the keyways of the first rotational locking area 130*a* when the sleeve is slid onto the shear body from the first end 106*a* thereof during assembly of the coupling. The sleeve's rectangular keys are separated from one another by a series of identical arcuately shaped keyways 137 that are equal in number to the keys at each rotational locking area of the shear body, and are sized for axial sliding receipt of the arc-shaped keys 132 of the first rotational locking area of the shear body during this installation of the sleeve.

With particular reference to FIG. 19, which like FIG. 18 shows the shear body in isolation prior to assembly thereof with the hollow sleeve, the spline profile (including the number, shape and size of keys and keyways) at the two rotational locking areas of the shear body are identical, but angularly offset from one another about the longitudinal axis 200 of the shear body, as denoted by angular offset angle α. Each key and keyway on the shear body is therefore situated slightly out of alignment with a respective key or keyway at the other rotational locking area of the shear body. This angular offset between the two rotational locking areas enables the application of a torsional pre-load to the shear body 106'.

To achieve this torque pre-load during assembly of the coupler, the shear body 106' is held stationary at the second end 106*b* thereof, and the sleeve 102' is placed in concentric alignment with the shear body at the first end 106*a* thereof. The sleeve 102' is slid onwardly toward the second end 106*b* of the shear body in order to engage the splined inner profile of the sleeve 102' with the first rotational locking area 130*a* of the shear body. However, due to the misalignment between the two rotational locking areas 130*a*, 130*b* of the shear body 106', the sleeve 102' cannot be simply slid onward into mating engagement with the second rotational locking area 130*b*.

To enable this sliding of the sleeve 102' into its final installed position, a suitable torquing tool is coupled to the first end 106*a* of the shear body, and is used to apply a predetermined torsional load to the shear body that twists the shear neck 54 of the shear body about the longitudinal axis 200 by an angular amount of equal but opposite magnitude to the angular offset angle α, whereupon the splined profiles of the two rotational locking areas of the shear body are now in alignment with another. With the shear body held in this torsionally loaded state by the torque application tool, the sleeve is now axially displaced further along the longitudinal direction of the shear body in order to slide the splined internal profile of the sleeve 102' into meshing relation with the second rotational locking area 130*b* of the shear body 106', as enabled by the spline-aligning torque applied thereto by the tool.

With the sleeve now engaged with both rotational locking areas 130*a*, 130*b* of the shear body 106', and fully abutted against the second external shoulder 122 thereof, the uniform internal spline profile of the sleeve holds the two initially-misaligned spline profiles on the shear body in alignment with one another. The torque exerted on the shear body by the torque tool is released, and the torque-tool is detached from the shear body, at which point the mating splines of the shear body and sleeve maintain the shear body in the torsionally pre-loaded state induced by the tool. The stop ring 104 (like that of the fifth embodiment) is then fitted onto shear body to axially hold the sleeve in place against the second external shoulder 122 of the shear body, thereby completing the assembly of the pre-torqued coupler of the sixth embodiment.

The illustrated sixth embodiment features two misaligned anti-rotation profiles (e.g. two angularly offset splines) on the exterior of the shear body and a singular anti-rotation profile (e.g. a single uniform spline) on the interior of the sleeve, and therefore requires torsional twisting of the two shear body profiles into alignment during the assembly process. Other embodiments may instead employ two angularly aligned profiles on the shear body and two angularly mis-aligned profiles on the sleeve, in which case the assembly process would instead involve twisting of the shear body into a condition bringing the two shear body profiles into a state of angular mis-alignment that is equal in measure to the pre-manufactured misalignment of the two sleeve profiles. However, the manufacture of two offset internal profiles on the hollow sleeve may be more complicated using conventional machining techniques than the manufacture of a single uniform sleeve profile and two mis-aligned external shear body profiles.

Figure 21:
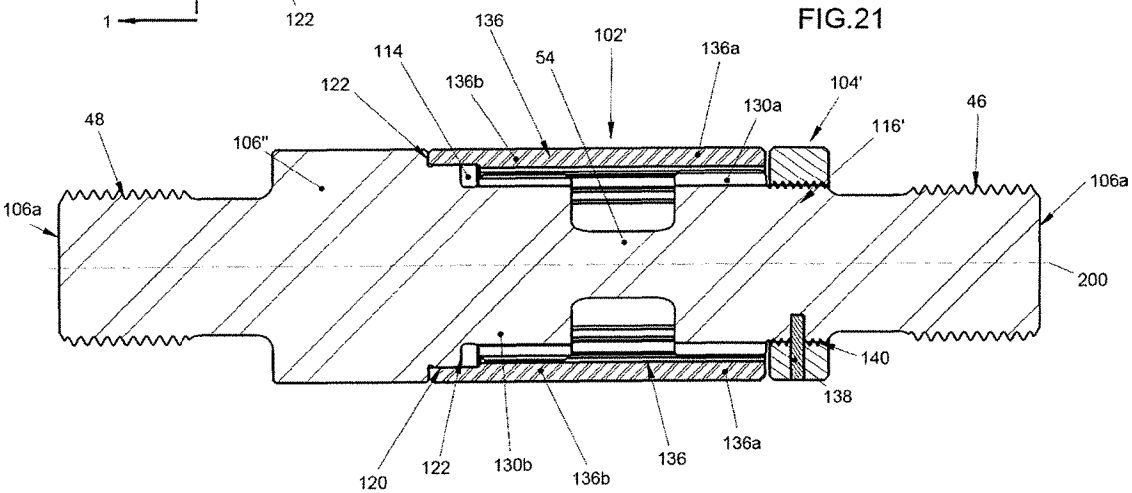
FIG. 21 is a cross-sectional view of the shear coupler of FIG. 20, as viewed along line B-B thereof.

In the illustrated sixth embodiment, the uniform interior profile of the sleeve may be considered to be divided into two separate areas spaced apart along the axial direction of the sleeve, each of which overlies a respective one of the two anti-rotation areas 130*a*, 130*b* of the shear body 106' in the final installed position of the sleeve. Accordingly, in FIG. 21, two different areas of the spline key 136 in FIG. 21 are labeled as first key area 136*a* and second key area 136*b*. Accordingly, in the illustrated sixth embodiment, both the sleeve and the shear body each have two rotational locking areas, with the difference being that the two profiled areas of the shear body 130*a*, 130*b* are angularly offset or misaligned with one another, while the two profiled areas of the sleeve 136*a*, 136*b* are aligned in a non-offset relation to one another as continuously integral parts of a larger, uniformly profiled area of the sleeve.

In such a case, prior to the assembly of the shear coupler, the angular measure between a given key or keyway at either splined area 136*a*, 136*b* of the sleeve and a corresponding key or keyway at the other splined area of the sleeve (which in the case of the illustrated sixth embodiment is zero degrees) is different than the angular measure between a given key or keyway at either splined area 130*a*, 130*b* of the shear member and a corresponding key or keyway at the other splined area of the shear member (which in the case of the illustrated sixth embodiment is non-zero value α). Only through the applied torque during the assembly process is the angular measure between the two areas 130*a*, 130*b* of the shear body brought into equality to the angular measure between the two areas 136*a*, 136*b* of the hollow member (in the case of illustrated embodiment, being reduced from initial value α down to 0°) to allow full mating of the sleeve into its final installed position.

While the sixth embodiment uses splined profiles, the same torsional pre-loading process using initially mis-aligned anti-rotation profiles may similarly be employed with the polygonal profiles of the fifth embodiment. The uniform generally polygonal sleeve profile 111 of the fifth embodiment may likewise be considered divided into two halves or areas 111*a*, 111*b*, each overlying a different rotational interlocking area 107*a*, 107*b* of the shear member and defining a respective set of rotational interlocking features for mating with the corresponding features of that interlocking area of the shear member. In addition to use of polygonal peripheral shapes or parallel key splines, the same torsional pre-loading may be employed with other spline types, including involute splines, crowned splines, serrations, or helical splines. Splines and polygonal shapes are only select examples of possible mating profiles that can be used to rotationally lock the sleeve and shear body together for torque transfer therebetween, and other profiles likewise capable of torque transfer in the assembled coupling and torsional pre-loading into mating alignment during the assembly process may alternatively be employed. Accordingly, the peripheral features (spline keys, polygonal facets, etc.) used to achieve the rotationally locked state between the shear body and surrounding sleeve are not limited to those specifically used in the illustrated embodiments.

Also, while the illustrated sixth embodiment employs a pre-manufactured angular offset between the rotational locking areas on only one of the sleeve or the shear body, other embodiments may alternatively feature angular offsets of non-matching angular measure on both components. This would similarly result in misalignment of one rotational locking area on the sleeve with the corresponding rotational locking area on the shear body when the other two areas on the sleeve and shear body are aligned, until the shear body is torqued into a pre-loaded condition bringing the second pair of rotational locking areas in matable alignment.

The enlarged cylindrical end space 114 of the sleeve 102' creates a reduced-thickness area of the sleeve that axially extends from the internally splined area of the sleeve. This axial extension of the sleeve has an axial length which exceeds that of the corresponding cylindrical seating area 120 on the shear body 106", whereby an axial gap is left between the shoulder 122 of this seating area 120 and the nearest end of the sleeve's internal spline. This axial extension of the sleeve serves to reduce maximum torsional stress by giving the stress some volume of material to release.

To summarize the sixth embodiment, through the above-described angular offset manufactured into the two torque profiles on the pin and/or sleeve, torque can be introduced into the assembly process such that the pin and sleeve have preload during a rest state to keep the stress state of the pin/sleeve in a positive torque state for the life of the part, even when application (i.e. field-use) loading is absent. Similar to the prior art use of tensile preload in couplers intended for reciprocating pump applications, it is believed that that the torque preload of the present invention can enhance fatigue performance of rotating rod shears for progressive cavity pump applications relying on rotational (as opposed to reciprocating) drive of the sucker rod string. The idea is to provide a positive amount of pre-torque. Shear stress is proportional to torque. In the same way as pre-tension improves tensile fatigue life by reducing tensile stress variation, pre-torque will improve shear fatigue life by reducing torsional stress variation. In particular, with pre-torque (and similar to pre-tension), the shear stress will never reduce to zero. The shear stress will always remain positive in both the sleeve and the shear body. It will be appreciated that the particular value of the offset angle $\alpha$ may be varied, for example according to a desired amount of torsional pre-load, which is proportional to the selected value of the offset angle.

Figure 20:
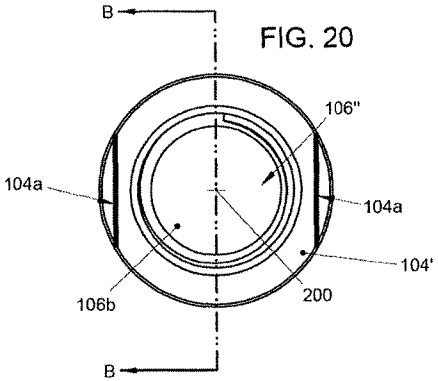
FIG. 20 is an end view of a seventh embodiment shear coupler.
Figure 25:
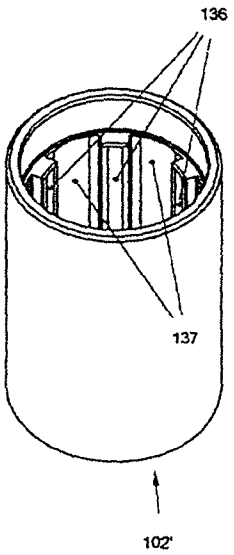
FIG. 25 is another perspective view of the hollow sleeve member of FIG. 22 from another end thereof.
Figure 24:
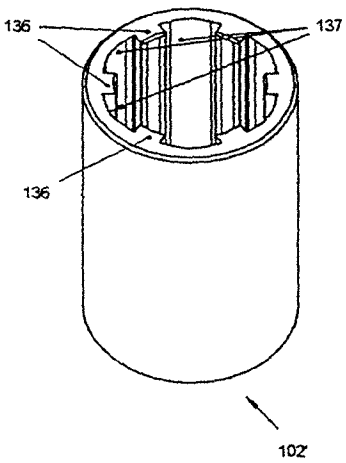
FIG. 24 is a perspective view of the hollow sleeve member of FIG. 22 from one end thereof.
Figure 23:
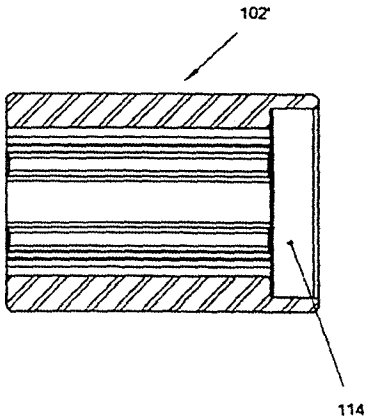
FIG. 23 is a cross-sectional view of the hollow sleeve member of FIG. 22, as viewed along line A-A thereof.
Figure 22:
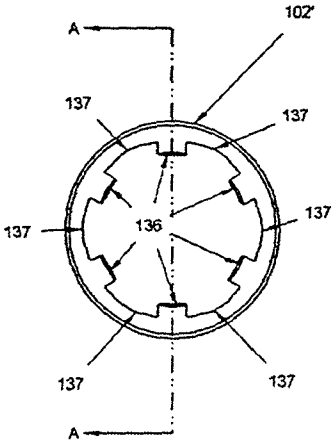
FIG. 22 is an end view of a hollow sleeve member of the sixth and seventh embodiments.

FIGS. 20 and 21 illustrate a seventh embodiment that, similar to the sixth embodiment, employs a splined shear body exterior and a splined sleeve body interior. The seventh embodiment includes additional features to enable tensile pre-loading of the coupling. Embodiments including such tensile pre-loading optionally may include the torsional pre-loading described above with reference to the sixth embodiment. Accordingly, the splined areas of the shear body and sleeve may include or lack an angular offset feature according to whether torsional pre-loading is desired for an intended application of the coupling. Embodiments including both torsional and tensile pre-loading may be useful for both reciprocating and rotary applications.

Like that of the sixth embodiment, the shear body 106" of the seventh embodiment features first and second pin ends 106*a*, 106*b* spaced apart in the longitudinally axial direction, a reduced diameter shear neck 54 positioned at a longitudinally intermediate location between the pin ends, first and second spline-shaped locking areas 130*a*, 130*b* situated on opposite sides of the shear neck 54, a first seating area 116' located between the first rotational locking area 130*a* and the first pin end 106*a* of the shear body, and a second seating area 120 at an external shoulder 122 located between the second rotational locking area 130*b* and the second pin end 106*b* of the shear body. The shear body 106" differs from that of the sixth embodiment in that the first seating area 116' for receiving the stop ring 104' is externally threaded, and therefore does not have a smooth walled cylindrical outer surface for a press-fitted stop ring like the fifth and sixth embodiments. Instead, the stop ring 104' is an internally threaded stop nut that threads onto the externally threaded seating area 116', and the shear body 106" lacks an external shoulder at the connection between the seating area 116' and the first rotational lock area 130*a*. As a result, sufficient advancement of the stop nut 104' on the threaded seating area 116' of the shear body will drive the stop nut into contact with the internally splined end of the sleeve, and thereby force the cylindrically hollowed (i.e. unsplined) end 114 of the sleeve 102' against the external shoulder 122 of the shear body.

During assembly of the coupler, when the stop nut 104' is fully threaded onto the seating area 116' to define the sleeve's fully installed position abutting against the corresponding external shoulder 122 of the shear body, a radial bore is drilled through the stop nut 104' and into the underlying threaded seating area 116' of the shear body 106". This bore then receives a locking device that prevents rotation of the fully installed stop nut 104' and thereby prevents the stop nut 104' from backing off of the fully seated sleeve 102'. The locking device may be a threaded set screw 138, in which case the radial bore is drilled and tapped, or alternatively a spring pin may be used as the locking device, and received in a smooth-walled bore to avoid the extra tapping step in the production of the finished coupler. Drilling through the already-positioned stop nut 104' during the assembly process avoids the need to accurately predict the intended final locking position of the stop nut if pre-drilled holes were instead created separately in the stop nut and shear body prior to assembly. However, such pre-drilling of a through hole in the stop nut and corresponding blind hole in the shear body would still be within the scope of the present invention.

The stop nut 104', and the threaded engagement thereof on the shear body 106", enables pre-tensioning of the shear body 106 during assembly of the coupling. During this assembly process, the shear body 106" is held stationary at the second end 106*b* thereof. The sleeve 102' is slid onto the shear body from the opposing first end 106*a* thereof, and then axially advanced into its fully seated position abutted against the external shoulder 122 of the shear body 106. The external threading 140 on the threaded seating area 116' is left exposed outside the splined end of the sleeve that lies opposite to the shoulder-abutted, cylindrically hollowed end of the sleeve. The stop nut 104' is passed over the first end 106*a* of the shear body 106" into a position encircling the shear body, for example being partially threaded onto the exposed threading 140 at the seating area 116'. At this point, a suitable tensioning tool capable of exerting an axial pull force, such as a hydraulic cylinder, is coupled to the first end 106*a* of the shear body 106". With the opposing end 106*b* of the shear body held stationary, a tensile pulling force is exerted on the first end 106*a* of the shear body in the longitudinal/axial direction thereof using the tensioning tool, whereby the shear neck 54 of the shear body is brought into a tensioned state.

With this tensile force maintained, the stop nut 104' is advanced further onto the threaded seating area 116' into abutment with the internally splined end of the hollow sleeve 102', thereby forcing the opposing unsplined end of the sleeve 102" against the external shoulder 122 of the shear body 106" and achieving an axially compressed state of the sleeve 102. A radial bore is drilled and the locking device 138 is engaged within this bore, thereby locking the stop nut 104' in place. At this point, the tensile force is removed from the end 106*a* of the shear body, and the tensioning tool is detached from same. The threaded engagement and rotationally locked condition of the stop nut 104' on the shear body maintains the compressed state of the sleeve and the tensioned state of the shear body neck 54 inside the sleeve. The locked condition of the stop nut 104' not only prevents it from backing off of the sleeve, but also prevents the stop nut from advancing further along the shear body under the action of a rotary drive source via the sucker rod that abuts against the stop nut at the top end of the coupler. Such unintended advancement of the stop nut 104' could otherwise increase the axial load on the shear neck, and potentially lead to premature yield.

In the illustrated embodiment, the diameter of the external threading 140 on the threaded seating area 116' of the shear body is slightly smaller than the interior diameter of the sleeve 102' in order to enable sliding of the sleeve 102' over the seating area 116' during assembly of the coupling. However, the seating area threads 140 are larger in diameter than the external threading 46, 48 at the pin ends of the shear body. This embodiment therefore carries the axial preload on a thread that is larger than the thread size of the pin ends 106*a*, 106*b* of the shear body, which is typically dictated by standardized sucker rod interface thread sizes (e.g. ¾", ⅞", 1", 1⅛" API sucker rod threads). As a result, during use of the coupling, axial loading on the shear body by the sucker rods coupled thereto is handled by this relatively large threading 140 that exceeds the thread size of the actual connection between the coupler and the sucker rods. Accordingly, the axial load handling capability is improved over prior designs that use smaller diameter threads to achieve a pre-tensioned state of the shear body.

As mentioned above, some embodiments may employ both tensile and torsional pre-loads, in which case the assembly process includes subjecting the shear body to a torsional load during placement of the sleeve thereon, and subjecting the shear body to a tensile load during subsequent tightening of the stop nut 104'.

While the fifth through seventh embodiments are described and illustrated as having two male pin ends on the shear body, it will be appreciated that while a reduced diameter pin is required at one end to enable sliding of the sleeve and stop ring into place, the opposing end could alternatively be a female box end with internal threading for direct coupling an adjacent sucker rod, instead of indirect coupling thereto via an intermediate box coupling. In addition, while the illustrated embodiments have been described in the context of being coupled between individual rods in a conventional string, use of the term sucker rod string herein also encompasses use of the shear coupler between two sections of continuous rod (or co-rod) in a string made up of two or more such sections of continuous rod.

Figure 26:
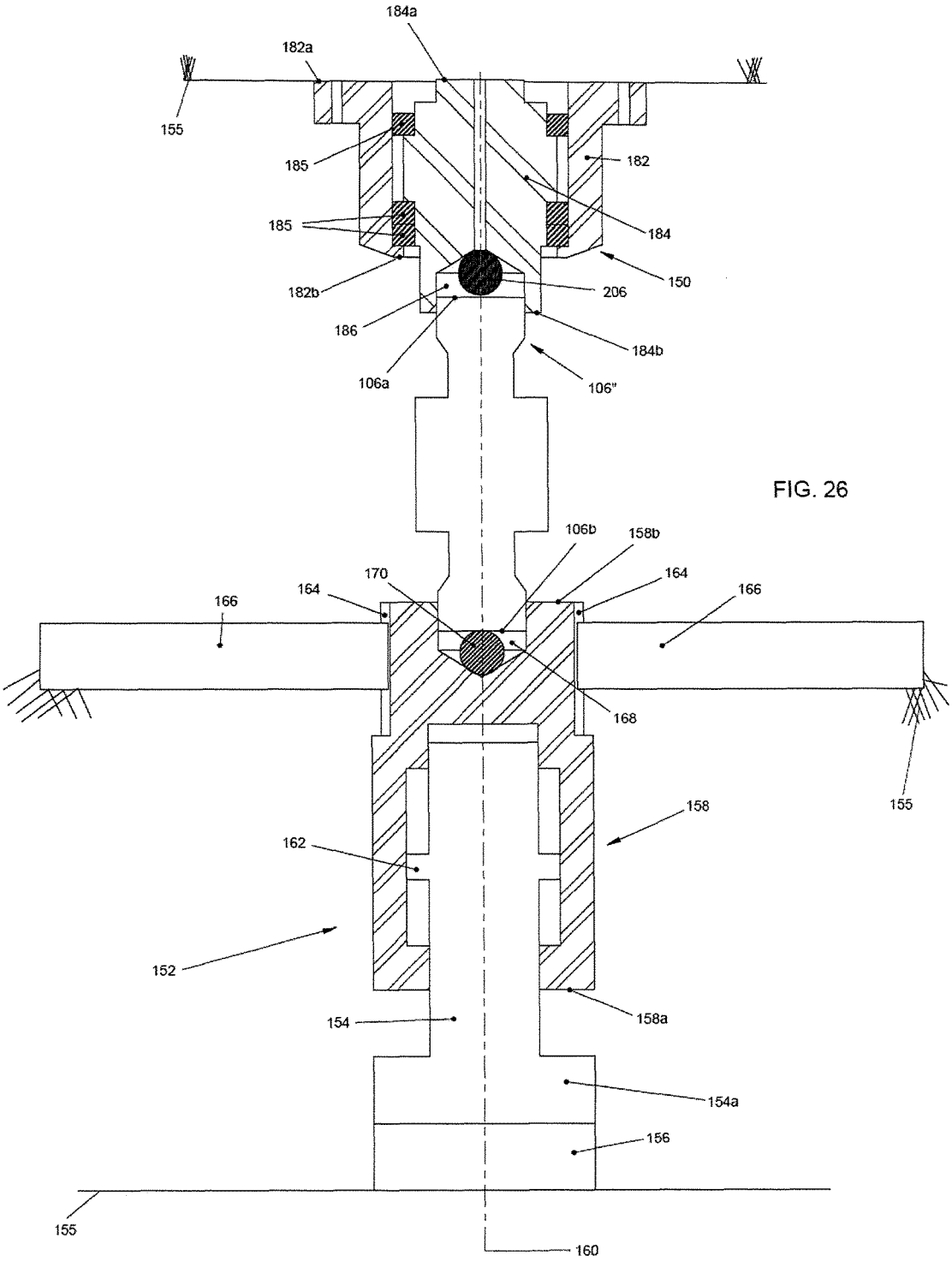
FIG. 26 schematically illustrates one embodiment of a system of equipment for assembling the seventh embodiment shear coupler of FIG. 20 in a manner providing torsional and tensile pre-loads thereto.
Figure 27:
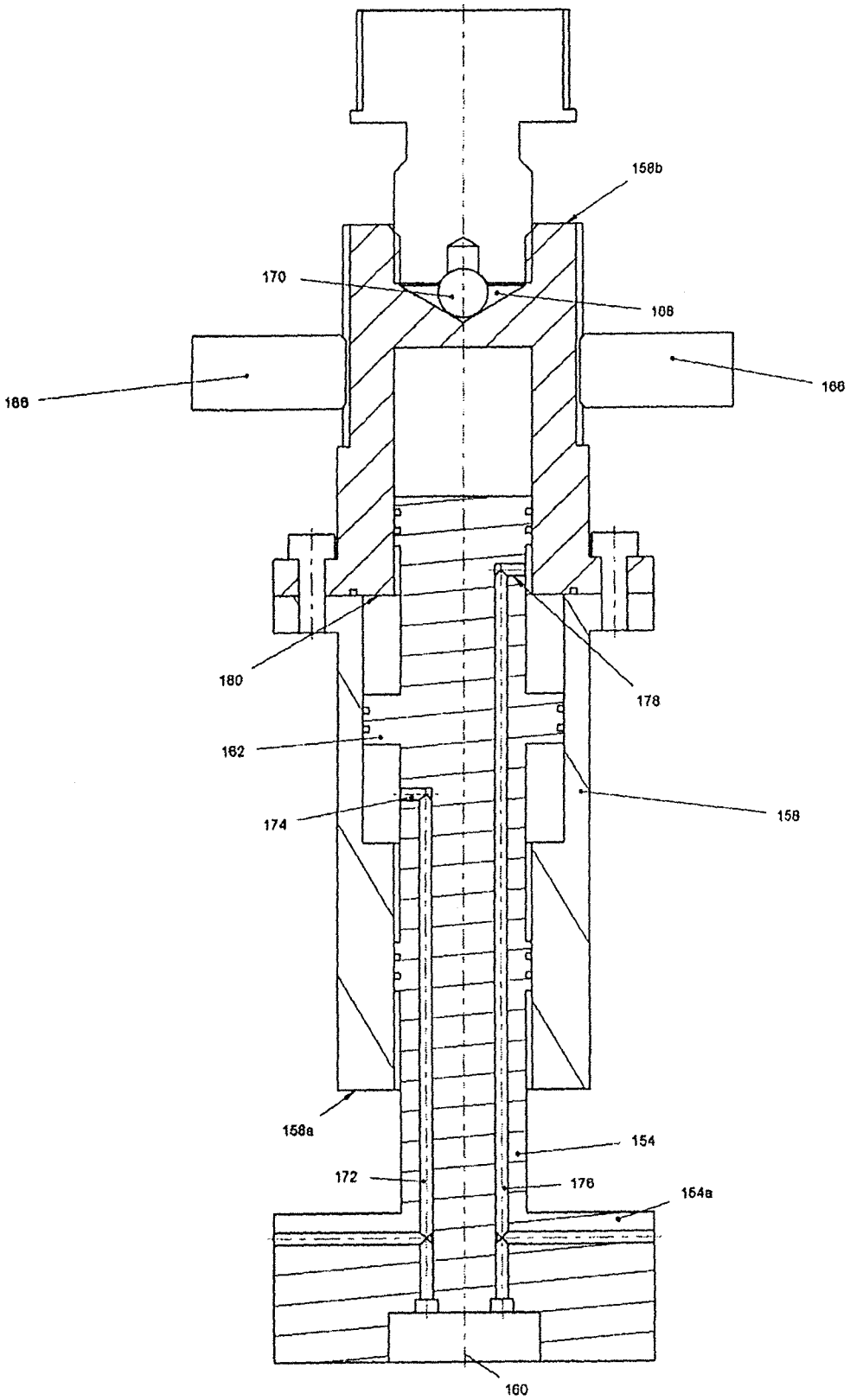
FIG. 27 schematically illustrates a lower fixture of the system of FIG. 26 that engages a lower end of the shear body during assembly of the shear coupler.
Figure 28:
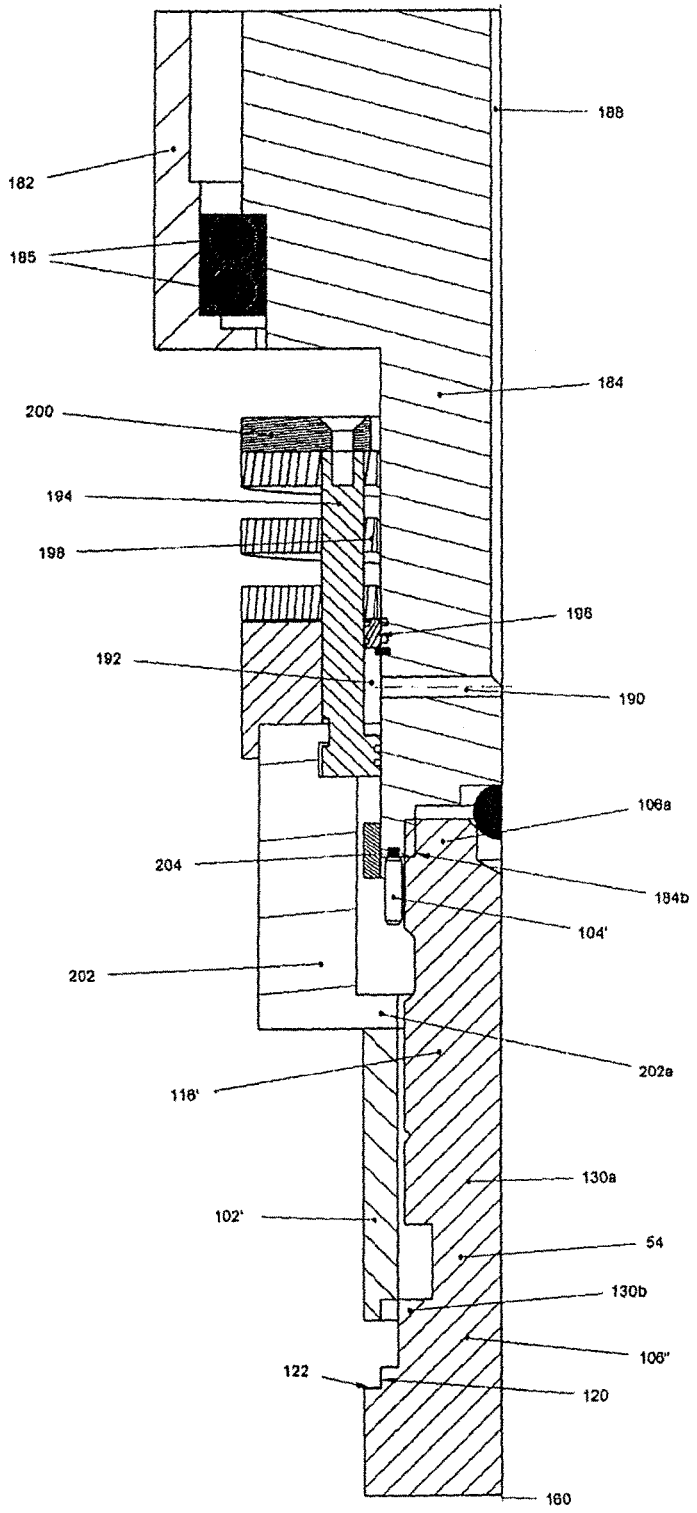
FIG. 28 partially and schematically illustrates an upper fixture of the system of FIG. 26, particularly a lower portion of the upper fixture that engages an upper end of the shear body during assembly of the shear coupler.

FIGS. 26 through 28 illustrate one embodiment of a system that is usable to assemble the shear coupler of the seventh embodiment in manner providing a tensile pre-load, torsional pre-load, or both. With particular reference to FIG. 26, the system features an upper fixture 150 that interacts with the first end 106*a* of the shear body during the assembly process, and a separate lower fixture 152 that interacts with the second end 106*b* of the shear body.

With reference to FIG. 26, the lower fixture 152 features a stationary piston shaft 154 affixed to the ground or other stationary reference frame 155 and standing upright from atop a load cell 156 that is operable to measure tension applied to the shear body 106" during the assembly process. A thick-walled cylinder 158 closes around the piston shaft 154 at a distance spaced upward from base 154*a* thereof that is seated atop the load cell 156. A lower end 158*a* of the cylinder 158 is circumferentially sealed around the piston shaft 154 in a fluid-tight manner and is axially slidable along the vertically upright longitudinal axis 160 of the piston shaft 154. A piston 162 projects radially outward from the shaft into sealed, slidable contact with the inner surface of the cylinder's circumferential wall. A pair of slots 164 provided in the exterior of the cylinder's circumferential wall run axially downward from the upper end 158*b* of the cylinder 158. Each slot 164 receives the free end of a respective torque reaction arm 166 provided in the form of a rigid bar whose opposite end is affixed to the same stationary reference frame 155 as the piston shaft 154. The arms 166 prevent rotation of the cylinder 158 around the longitudinal axis 160. The upper end of the cylinder 158*b* features a blind hole 168 extending thereinto from outside the cylinder. The blind hole 168 features a threaded, cylindrically-shaped outer portion, from which a conically-shaped inner portion of the hole 168 tapers to a point that resides on the central longitudinal axis 160 at the closed inner end of the hole. A ball bearing 170 is seated at this conically tapered inner end of the hole 168.

Turning to FIG. 27 a cylinder retraction channel 172 enters the base 154*a* of the piston shaft 154, from which it then runs axially up the shaft to a radial discharge port 174 situated below the piston 162. A cylinder extension channel 176 likewise enters the base 154*a* of the piston shaft 154, and runs axially up the shaft to a radial discharge port 178 situated above the piston 162. Introduction of pressurized hydraulic fluid into the cylinder retraction channel 172 pressurizes the internal space of the cylinder 158 below the piston 162, thereby driving the cylinder 158 downwardly toward the base 154*a*. Introduction of pressurized hydraulic fluid into the cylinder extension channel 176 pressurizes the internal space of the cylinder 158 above the piston 162, which drives the cylinder 158 upwardly away from the base 154*a* by exerting an upward force against an internal shoulder 180 of the cylinder 158, at which the internal diameter of the cylinder steps down moving toward the upper end 158*b* thereof.

Turning back to FIG. 26, the upper fixture 150 features a housing 182 affixed to same stationary reference frame 155 as the base 154*a* of the lower fixture 154. A spindle 184 is supported in the frame 182 for rotation of the spindle around the central longitudinal axis 160 by way of suitable bearings 185. A top end 184*a* of the spindle extends through, or is accessible via, an open top end 182*a* of the housing 184 for driven rotation of the spindle by a suitable rotational drive source, for example via one or more pairs of wrench flats defined externally on the top end of the spindle by a hexagonal or flat-sided cross-sectional shape thereof. The lower end 184*b* of the spindle reaches downwardly from the lower end 182*b* of the housing 182, and resides at an elevation spaced above the top end 158*b* of the lower fixture's cylinder 158. A blind hole 186 extends axially upward into the lower end 184*b* of the spindle in alignment with the blind hole 168 of the lower fixture 152 on the central longitudinal axis 160. The blind hole 186 of the upper fixture 150 has the same configuration as that of the lower fixture, featuring a cylindrical outer end and a conically tapered inner end.

Figure 29:
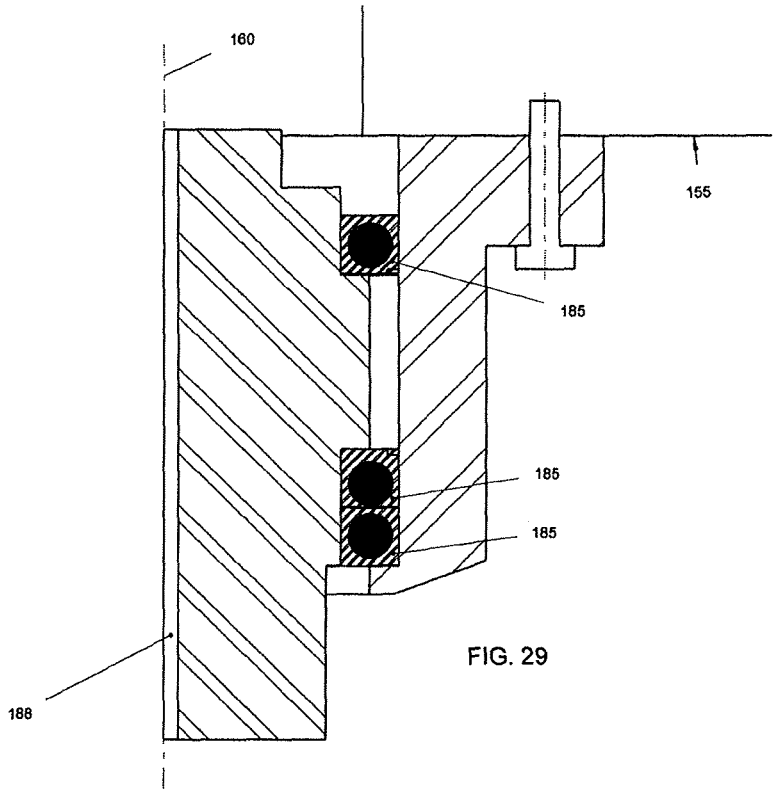
FIG. 29 schematically illustrates another portion of the upper fixture of the system of FIG. 26, particularly an upper portion that rotatably supports a spindle by which the torsional pre-load is applied to the shear body during assembly of the shear coupler.

With reference to FIG. 29, a hydraulic passage 188 runs axially downward into the spindle 184 from the top end 184*a* thereof, where a suitable coupling is provided for connection to a pump providing a pressurized source of hydraulic fluid.

For illustrative simplicity, FIG. 29 shows one half of a symmetric upper portion of the upper fixture whose line of symmetry is defined by the central longitudinal axis 160. Turning to FIG. 28, a short height above the lower end 184*b* of the spindle 184, the hydraulic passage 188 exits the spindle through one or more radial discharge ports 190 into an annular space 192 inside a hollow cylinder 194 that concentrically surrounds a nose of the spindle near the lower end 184*b* thereof. Like the upper portion shown in FIG. 29, the lower portion of the upper fixture shown in FIG. 28 is substantially symmetric across the longitudinal axis 160, and so FIG. 28 omits half of the fixture in the interest of illustrative simplicity. The annular internal space of the nose cylinder 194 is slidably sealed directly to the exterior of the spindle 184 below the hydraulic discharge port 190, and slidably sealed to an external flange 196 found on the spindle 184 at a location above the hydraulic discharge port 190. Pressurization of this space 192 by hydraulic fluid conveyed thereto through the hydraulic passage 188 drives the nose cylinder 194 downwardly toward the lower end 184*b* of the spindle.

A compression spring 198 coils around the spindle between the external flange 196 thereof and an annular upper end 200 of the nose cylinder 194 that closes around the spindle at distance above the external flange 196. The compression spring 198 serves as a return spring that biases the nose cylinder upwardly away from the lower end 184*b* of the spindle in order to return the nose cylinder to a default retracted position upon removal of the hydraulic pressurization that drives the nose cylinder downward into an extended position. A split ring 202 is removably mountable to the nose cylinder 194 at the end thereof nearest the lower end 184*b* of the spindle, and one or more magnets 204 are embedded or otherwise mounted on the spindle at the annular lower end 184*b* thereof that closes around the blind hole 186 therein.

Having described the structure of the assembly system equipment, attention is now turned to the use thereof to assemble and pre-load the shear coupler of the seventh embodiment. Firstly, the hollow sleeve 102' of the shear coupler is slid partially onto the shear body 106" from the first end 106*a* thereof, followed by the stop nut 104'. The second end 106*b* of the shear body is inserted into the blind hole 168 at the female upper end 158*b* of the thick-walled cylinder 158 of the lower fixture 152. The internal threads of the blind hole 168 are configured to mate with the external threads of the pin-end 106*b* of the shear body 106". This threaded connection is advanced until the end 106*b* of the shear body tightens up against the ball bearing 170 in the bottom of the blind hole 168, whereupon the shear body is now securely anchored to and supported by the lower cylinder 158 in a position standing upright on the central longitudinal axis 160.

Next, the lower cylinder 158 is extended upwardly by pumping of hydraulic fluid thereinto via the extension channel 176 of the piston shaft 154, thereby raising the shear body 106" toward the upper fixture 150. With a second ball bearing 206 seated atop the first end 106*a* of the shear body, or with a ball bearing already retained in the conical upper portion of the blind hole 186 in the female lower end 184*b* of the spindle, this raising of the cylinder 158 is continued until the first end 106*a* of the shear body 106" reaches into the blind hole 186 of the spindle 184, whose threading is configured to mate with that of the first pin end 106*a* of the shear body. From its upper end 184*a*, the spindle is rotationally driven about the longitudinal axis 160 in a direction advancing the threaded engagement between the spindle 184 and the first end 106*a* of the shear body 106" until the shear body bottoms out against the ball bearings 170, 206 in the blind holes 158, 186 of the upper and lower fixtures.

At this point, the extension channel 176 of the piston shaft 154 and respective side of the lower assembly's cylinder 158 are depressurized, and the other side of lower cylinder 158 is instead pressurized via the retraction channel 172. As a result, the lower cylinder pulls downwardly on the lower end 106*b* of the shear body 106", whose opposite end 106*a* is being held fast against this pulling force by its threaded engagement with the spindle 184. Accordingly, this retraction of the lower cylinder 158 applies a tensile load to the shear body 106". When the desired tensile load is achieved, for example as detected by the load cell 156, this tensile force is maintained by the lower cylinder 158 through subsequent steps in the assembly/preloading process. The stop nut 104' spanning around the shear body 106" between the sleeve 102' and the spindle-engaged pin end 106*a* of the shear body, if not already magnetically attracted to the magnet-equipped lower end 184 of the spindle 184, is lifted up into sufficient proximity thereto to establish this magnetic attachment to the nose of the spindle. Next, with reference to FIG. 28, the split ring 202 is mounted to the nose cylinder 194. In this mounted position, the split ring 202 reaches downwardly past the magnetically suspended stop ring 104', where an inwardly directed flange 202*a* at the lower end of the split ring 202 juts radially inwardly into an open axial space between the magnetically suspended stop ring 104' hanging from the nose of the spindle 184 and the as-yet unseated hollow sleeve 102' of the shear coupler.

At this point, still maintaining the desired tensile load on the shear body using the lower cylinder 158, a torque is applied to the spindle 184 at the top end thereof 184' in the same direction in which the spindle was threaded into engagement with the first end 106*a* of the shear body. During this application of torque, the second end 106*b* of the shear body 106" is held fast against rotation by its threaded engagement with the lower cylinder 158, which in turn is held fast against rotation by the torque reaction bars 166. As such, the torque exerted by the spindle 184 twists the shear neck 54 of the shear body 106", and the exerted torque is carefully controlled so as to attain the required alignment between the splines of the two rotational locking areas of the shear body. With this spline alignment achieved, the nose cylinder 194 is extended downward, whereby the inward flange 202*a* of the split ring 202 forces the sleeve 102' down into the fully seated position abutting against the shoulder 122 of the shear body 106".

At this point, the nose cylinder 194 is depressurized, whereupon the return spring 198 draws the nose cylinder and attached split ring 202 back upward to the retracted position, at which point the split ring is then removed. The stop nut 104' is pulled down out of its magnetic coupling with the spindle, and is threaded onto the threaded seating area 116' of the shear body 106", preferably in the presence of a thread adhesive. The stop nut 104' is then torqued tight against the end of the sleeve 102', for example using a hook spanner wrenching tool engaging predrilled holes or slots machined into 104'. Such wrenching tools and suitable configuration of cooperating holes or slots in locking ring components are well known to those of skill in the art, and therefore not illustrated or described herein in further detail. At this point, the spindle-applied torque is removed, as is the tensile force previously applied and maintained by the lower cylinder 158, as the tensile and torsional pre-loads applied to the shear body 106" are now held by the installed stop nut 104' and hollow sleeve 102'. To finish off the overall assembly of the shear coupler, the radial hole in the stop nut 104' and corresponding seating area 116' of the shear body is drilled, and optionally tapped, in order to accommodate placement of the set screw, spring pin or other locking device 138 that will thereby prevent rotation of the installed stop nut 104'. The drilling and locking device installation may be performed after removal of the shear pin from the upper and lower assemblies 150, 152.

While the fixtures illustrated in FIGS. 26 through 29 enable both tensile and torsional preloading of the coupler, it will be appreciated that the same equipment may alternatively be used to apply only one of the two different types of preload. To apply only torsional pre-load, the same coupling of the shear body between the two fixtures and application of torque thereto via the spindle is performed without using the lower fixture to pull on the shear body and create the tensile pre-load. To apply only tensile pre-load, the torque-application step prior to placement of the hollow sleeve via the nose cylinder is instead omitted.

It will also be appreciated that assembly and pre-loading equipment other than the particular fixture design illustrated in FIGS. 26 through 29 may alternatively be employed to apply tensile and/or torsional loading in the more general manner described elsewhere herein.

Since various modifications can be made in my invention as herein above described, and many apparently widely different embodiments of same made within the scope of the claims without departure from such scope, it is intended that all matter contained in the accompanying specification shall be interpreted as illustrative only and not in a limiting sense.

The invention claimed is:

1. A shear coupler for providing a breakable connection between adjacent members of a sucker rod string for use in a wellbore, the shear coupler comprising:

a shear member (106/106'/106") comprising an elongated stud having opposing first and second ends (106*a*, 106*b*) spaced apart along a longitudinal axis (200), first and second sets of threads (46, 48) defined on the shear member at locations respectively adjacent the opposing first and second ends thereof, and a weakened area (54) on the elongated stud at an intermediate location between the first and second sets of threads;

a hollow member (102/102') having a hollow interior that extends thereinto from an open end of said hollow member along a longitudinal axis thereof, the first end of the shear member being passable through the open end of said hollow member to place the outer member in an installed position closing around the shear member; and a first set of rotational locking features (107*a*/130*a*) externally defined on the shear member for engagement thereof in the installed position with a first set of matable rotational locking features (111*a*/136*a*) internally defined on the hollow member;

a second set of rotational locking features (107*b*/130*b*) externally defined on the shear member for engagement thereof in the installed position with a second set of matable rotational locking features (111*b*/136*b*) internally defined on the hollow member; and the first and second sets of rotational locking features of the shear member being disposed on opposite sides of the weakened area thereof, and being arranged to mate with the matable rotational locking features of the hollow member in the installed position in a manner locking the hollow member from rotation relative to the shear member to enable torque transfer across the weakened area of the shear member via the hollow member disposed around said shear member; wherein an inner peripheral shape of the hollow member defines the matable rotational locking features thereof, a cooperating outer peripheral shape of the shear member defines the rotational locking features thereof and mates with the inner peripheral shape of the hollow member in the installed position to block relative rotation between the hollow member and the shear member, and said inner and outer peripheral shapes of the hollow and shear members comprise alignable facets (108*a*, 112*a*, 112*b*) thereon that face-together in the installed position of the hollow member to block said relative rotation between the hollow member and the shear member.

2. The shear coupler of claim 1 wherein the facets (112*a*, 112*b*) of the inner peripheral shape of the hollow member reside at sides of a polygonal area in cross-sectional planes of the hollow member, and the inner peripheral shape of the hollow member comprises radiused corners (110) between said sides of the polygonal area.

3. The shear coupler of claim 1 wherein the inner peripheral shape of the hollow member comprises a plurality of sides each comprising a respective pair of facets (112*a*) separated by a respective scalloped region (112*b*) between said pair of facets.

4. The shear coupler of claim 2 wherein the facets of the inner peripheral shape of the hollow member comprise a respective pair of facets (112*a*) at each side of the polygonal area that are separated by a respective scalloped region (112*b*) between said pair of facets.

5. The shear coupler of claim 1 wherein the shear member comprises an external shoulder (122) located between the second end (106*b*) of the shear member and the weakened area (54) thereof and facing toward the first end of the shear member (106*a*), and the shear coupler further comprises a stop ring (104/104') engaged onto the shear member to hold the hollow member (102/102') in place adjacent to the external shoulder (122) in the installed position.

6. The shear coupler of claim 5 wherein the shear member comprises an additional external shoulder (118) located between the first end (106*a*) of the shear member and the weakened area (54) thereof and facing toward the first end (106*a*) of the shear member, and the stop ring (104) is press fitted into abutment with said additional external shoulder (118).

7. The shear coupler of claim 5 wherein the stop ring (104') is threaded onto a third set of threads (140) on the shear member (106") at a position maintaining the shear member in axial tension.

8. The shear coupler of claim 7 wherein the third set of threads (140) on the shear member (106") are greater in diameter than the first and second sets of threads (46, 48) located adjacent the opposing first and second ends (106*a*, 106*b*) of the shear member (106").

9. The shear coupler of claim 7 comprising a locking member (138) rotationally locking the stop ring (104') to the shear member (106") to prevent relative rotation therebetween at the third set of threads (140).

10. The shear coupler of claim 5 wherein the first end (106*a*) of the shear member is a male pin end and the first set of threads (46) on the shear member are external threads on said male pin end for accepting threaded coupling of a box coupler onto said male pin end on a side of the stop ring (104/104') axially opposite the hollow member (102').

11. The shear coupler of claim 1 wherein the engagement of the rotational locking features of the shear body (106') and the matable rotational locking features of the hollow member (102') maintain the shear body in a pre-torqued state.

12. A method of assembling a shear coupler useful for providing a breakable connection between adjacent members of a string for running into a wellbore, the method comprising:

(a) having a shear member (106');

(b) having a hollow member (102');

(c) applying a torque to the shear member (106') in a manner twisting said shear member about a longitudinal axis (200) thereof;

(d) with the torque maintained on the shear member (106'), mating the hollow and shear members together into an assembled condition in which the hollow and shear members are in an interlocked relation with one another that prevents relative rotation therebetween about the longitudinal axis (200); and (e) removing the torque from the shear member (106'), whereupon a torsional pre-load is maintained in the shear member by the interlocked relation between the hollow and shear members;

wherein:

the shear member (106') comprises an elongated stud having opposing first and second ends (106*a*, 106*b*) spaced apart along the longitudinal axis (200) of said shear member, first and second sets of threads (46, 48) defined on the shear member at locations respectively adjacent the opposing first and second ends thereof, a weakened area (54) on the elongated stud at an intermediate location between the first and second sets of threads, a first set of peripheral shear member features (130*a*) on an outer periphery of the shear member (106') at a first location situated between the weakened area (54) of the shear member and the first end (106*a*) of the shear member, and a second set of peripheral shear member features (130*b*) defined on the outer periphery of the shear member (106') at a second location situated between the weakened area (54) of the shear member and the second end (106*b*) of the shear member;

the hollow member (102') comprises a hollow interior extending axially thereinto from an open end of said hollow member, a first set of peripheral hollow-member features (136*a*) on an inner periphery of the hollow member, and a second set of peripheral hollow-member features (136*b*) on the inner periphery of the hollow member at a position axially spaced from the first set of peripheral hollow-member features;

prior to step (c), an angular measure (a) between a first shear member feature from the first set of peripheral shear member features and a second peripheral shear member feature from the second set of peripheral shear member is unequal to an angular measure between a first hollow-member feature from the first set of peripheral hollow-member features and a second hollow-member feature from the second set of peripheral hollow-member features;

step (c) comprises applying the torque to the shear member in a manner twisting said shear member until the angular measures are equal; and step (d) comprises moving the hollow member and shear member relative to one another into a position engaging the peripheral shear member features with the peripheral hollow-member features in a manner achieving the interlocked relation between the hollow member and the shear member; and an engaged state of the peripheral shear member features with the peripheral hollow-member features in step (e) maintains the angular measures in equality, thereby maintaining the torsional pre-load in the shear member.

13. The method of claim 12 wherein the first and second sets of peripheral hollow-member features are in alignment with one another and the angular measure between the first and second hollow member features is zero, and step (c) comprises reducing the angular measure between the first and second shear member features to zero.

14. The method of claim 13 wherein the first and second sets of peripheral hollow-member features are integral, continuous areas of a uniform internal profile of the hollow member that spans across the weakened area of the shear member in the position achieved in step (d).

15. A method of assembling a shear coupler useful for providing a breakable connection between adjacent members of a string for running into a wellbore, the method comprising:

(a) having a shear member (106');

(b) having a hollow member (102');

(c) applying a torque to the shear member (106') in a manner twisting said shear member about a longitudinal axis (200) thereof;

(d) with the torque maintained on the shear member (106'), mating the hollow and shear members together into an assembled condition in which the hollow and shear members are in an interlocked relation with one another that prevents relative rotation therebetween about the longitudinal axis (200); and (e) removing the torque from the shear member (106'), whereupon a torsional pre-load is maintained in the shear member by the interlocked relation between the hollow and shear members;

wherein:

the shear member (106') comprises an elongated stud having opposing first and second ends (106*a*, 106*b*) spaced apart along the longitudinal of said shear member, first and second sets of threads (46, 48) defined on the shear member at locations respectively adjacent the opposing first and second ends thereof, a weakened area (54) on the elongated stud at an intermediate location between the first and second sets of threads;

the hollow member (102') comprises a hollow interior extending thereinto from an open end of said hollow member along a longitudinal axis thereof;

each of said members has respective first and second sets of peripheral features thereon, the first and second sets of peripheral features on the shear member (130*a*, 130*b*) being found at an outer periphery thereof and being disposed on axially opposite sides of the weakened area (54), and the first and second sets of peripheral features (136*a*, 136*b*) on the hollow member being found at an inner periphery thereof;

step (c) comprises applying the torque to the shear member in a manner angularly shifting the first set of peripheral features (130*a*) on said shear member around the longitudinal axis thereof relative to the second set of peripheral features (130*b*) on said shear member from an initially untorqued condition, in which the first sets of peripheral features on the shear and hollow members are in misalignment with one another when the second sets of peripheral features on the shear and hollow members are in alignment with one another, to a pre-torqued condition in which the first sets of peripheral features on the shear and hollow members are in alignment with one another when the second sets of peripheral features on the shear and hollow members are in alignment with one another;

step (d) comprises moving the hollow member (102') and shear member (106') relative to one another into a position engaging the first sets of peripheral features and the second sets of peripheral features respectively together to achieve the interlocked relation between the hollow member and the shear member; and the engaged peripheral features maintain the torsional pre-load in said shear member in step (e).

16. The method of claim 15 wherein the first and second sets of peripheral features on the hollow member are in alignment with one another.

17. The method of claim 16 wherein the first and second sets of peripheral features on the hollow member are integral, continuous areas of a uniform internal profile of the hollow member that spans across the weakened area of the shear member in the position achieved in step (d).

18. A method of assembling a shear coupler useful for providing a breakable connection between adjacent members of a string for running into a wellbore, the method comprising:

(a) having a shear member (106');

(b) having a hollow member (102');

(c) applying a torque to the shear member (106') in a manner twisting said shear member about a longitudinal axis (200) thereof;

(d) with the torque maintained on the shear member (106'), mating the hollow and shear members together into an assembled condition in which the hollow and shear members are in an interlocked relation with one another that prevents relative rotation therebetween about the longitudinal axis (200); and (e) removing the torque from the shear member (106'), whereupon a torsional pre-load is maintained in the shear member by the interlocked relation between the hollow and shear members;

wherein mating the hollow and shear members in step (d) comprises mating the hollow and shear members together in a position abutting a first end of the hollow member (102') against an external shoulder (122) on the shear member with a set of external threads (140) on the shear member (106") exposed outside the hollow member (102') beyond a second end thereof, and the method additionally comprises:

(i) applying a tensile force to the shear member (106") in an axial direction in which the external threads (140) on the shear member are spaced from the external shoulder (122) on the shear member;

(ii) with the tensile force maintained on the shear member (106"), advancing an internally threaded stop member (104') on the external threading (140) of the shear member into a position abutting the stop member against the second end of the hollow member (102'); and (iii) removing the tensile force from the shear member, whereupon a tensile pre-load is maintained in the shear member.

19. A method of assembling a shear coupler useful for providing a breakable connection between adjacent members of a string for running into a wellbore, the method comprising:

(a) having a shear member (106');

(b) having a hollow member (102');

(c) mating the hollow and shear members together in a position abutting a first end of the hollow member (102') against an external shoulder (122) on the shear member with a set of external threads (140) on the shear member (106") exposed outside the hollow member (102') beyond a second end thereof;

(c) applying a tensile force to the shear member (106") in an axial direction in which the external threads (140) on the shear member are spaced from the external shoulder (122) on the shear member;

(d) with the tensile force maintained on the shear member (106"), advancing an internally threaded stop member (104') on the external threading (140) of the shear member into a position abutting the stop member against the second end of the hollow member (102'); and (e) removing the tensile force from the shear member, whereupon a tensile pre-load is maintained in the shear member.

20. The method of claim 19 wherein the set of external threads on the shear body having a greater diameter than an externally threaded pin end of the shear member that is situated to a side of the set of external threads opposite the external shoulder of the shear member.

* * * * *